US010648188B1

(12) United States Patent
Krombein

(10) Patent No.: US 10,648,188 B1
(45) Date of Patent: May 12, 2020

(54) AGGREGATE RETAINING DEVICES FOR DRAINS AND DRAIN COVERS

(71) Applicant: Todd Krombein, Phoenix, AZ (US)

(72) Inventor: Todd Krombein, Phoenix, AZ (US)

( * ) Notice: Subject to any disclaimer, the term of this patent is extended or adjusted under 35 U.S.C. 154(b) by 0 days.

(21) Appl. No.: 15/702,590

(22) Filed: Sep. 12, 2017

Related U.S. Application Data

(60) Provisional application No. 62/394,038, filed on Sep. 13, 2016.

(51) Int. Cl.
*E04H 4/12* (2006.01)
*E04H 4/06* (2006.01)

(52) U.S. Cl.
CPC ..... *E04H 4/1236* (2013.01); *E04H 4/06* (2013.01)

(58) Field of Classification Search
CPC ..... E04H 4/1236; E04H 4/06
USPC ..... 4/507, 613
See application file for complete search history.

(56) References Cited

U.S. PATENT DOCUMENTS 6,340,035 B2 1/2002 Wright
6,810,537 B1 11/2004 Barnes et al.
8,713,724 B1 * 5/2014 Goettl ..... E04H 4/1236 4/507
9,540,837 B2 * 1/2017 Mjelde ..... E04H 4/1236
9,822,539 B1 * 11/2017 Krombein ..... E04H 4/1236
2013/0061387 A1 * 3/2013 Stetson ..... E03F 5/0408 4/613
2014/0250581 A1 * 9/2014 Mjelde ..... E04H 4/1236 4/507

OTHER PUBLICATIONS

Color Match Pebble Top Drain Covers advertisement, www.poolfittings.com, 1 page, cited on Aug. 23, 2016 in U.S. Appl. No. 13/794,376, filed Mar. 11, 2013, now U.S. Pat. No. 9,540,837. (Year: 2016).*

* cited by examiner

*Primary Examiner* — Tuan N Nguyen
(74) *Attorney, Agent, or Firm* — Knobbe Martens Olson & Bear LLP

(57) ABSTRACT

A drain assembly can be installed in a wall for containing an artificial body of water, such as a pool bottom and/or sidewalls. The drain assembly can be used with a water circulation system for the artificial body of water. The drain assembly has a plaster attachment device for securing a plaster mixture to the drain assembly. The plaster mixture can substantially match or look similar to the surface of the pool bottom and/or sidewalls.

18 Claims, 20 Drawing Sheets

AGGREGATE RETAINING DEVICES FOR DRAINS AND DRAIN COVERS

INCORPORATION BY REFERENCE TO ANY PRIORITY APPLICATIONS

Any and all applications for which a foreign or domestic priority claim is identified in the Application Data Sheet as filed with the present application are incorporated by reference and made a part of this specification.

BACKGROUND

Field

The present disclosure generally relates to drain assemblies for swimming pools and spas, and more particularly to apparatuses and devices for providing an exposed aggregate or plaster finish to drain assemblies for a pool, spa, or the like.

Description of the Related Art

Artificial bodies of water, such as pools, spas, fountains, ornamental ponds, utility ponds and the like, typically have filter systems that allow the water in the body of water to be filtered and cleaned. Typically, the water is removed from the artificial body of water via a drain and is pumped through a filtration or cleaning system. It is preferable that the water flows through the system as efficiently as possible.

Drain openings are often used as part of a pool cleaning system and are typically formed on the bottom of most swimming pools so that water can be removed from the pool and circulated through a filtration system. The openings generally extend through the floor of the pool and are connected to drain pipes that are configured to transport water from the pool to a filtering device. Furthermore, a recirculation pump is typically used to remove water from the pool through the drains, down the drain pipes, and into the filtration system wherein the water is filtered and cleaned before being transported back into the pool through the return lines.

Conventional drain openings are generally unsightly and can pose as a safety hazard for swimmers. A swimming pool tends to lose some of its aesthetic appeal when the floor of the pool is dotted with numerous drain openings. Various drains and covers have been developed for safety of swimmers while at the same time enhancing the aesthetic appeal of the pool.

This Background is provided to introduce a brief context for the Summary and Detailed Description that follow. This Background is not intended to be viewed as limiting the claimed subject matter to implementations that solve any or all of the disadvantages or problems presented herein.

SUMMARY

In particular, the standard drain assembly currently used for most swimming pools is a circular drain assembly. The drain assembly is adapted to be positioned over a generally circular drain opening and comprises a top surface and a plurality of side openings that serve as passage ways for water to flow from the pool into the drain assembly. Furthermore, the top surface is made from plastic material and is generally available only in a limited number of colors such as black, white, blue, and shades of gray.

Consequently, the standard drain assemblies often do not match the surface finish of the swimming pool as the surface finish of the pools can be made from a wide variety of colors and textures. In particular, the standard drain assemblies will appear conspicuously out of place when set against the surface finish of swimming pools having a plaster or exposed aggregate finish wherein the color of the surface is custom blended to the taste of the pool owner. Likewise, the standard drain assemblies also appear undesirably conspicuous when they are positioned over drain openings formed on the bottom of spas that are decorated with a colored plaster or exposed aggregate finish.

From the foregoing, it will be appreciated that there is a need to make drain assemblies for swimming pools or spas that are less conspicuous. To this end, there is a particular need for apparatuses and/or methods for matching a drain assembly to the surrounding surface.

A drain assembly for in-floor swimming pool cleaning systems according to an embodiment of the present disclosure is provided. The drain assembly comprises a plaster attachment device for securing and confining plaster, such as a plaster mixture, to a predetermined area on the drain assembly. The apparatus can include a plaster opening having a plaster securing upper surface with sidewalls to contain a plaster mixture which may include material or structure formed from a loosely compacted mass of fragments or particles such as pebbles. The apparatus can have other structures such as flanges, protrusions, bosses, grooves, indentations, and/or the like to facilitate securing the plaster in the plaster opening.

The plaster attached to the drain assembly can vary to match the wall and floor of the pool. In some embodiments, the drain assembly comprises a top having an upper surface. The upper surface can include the aggregate retaining device. A portion of the aggregate retaining device is recessed so as to define a cavity region wherein the cavity region is configured to retain plaster so as to provide the drain assembly with a plaster finish.

In some embodiments, the cavity is approximately between ⅛ inches to 1 inch deep and extends from the center of the upper surface to the outer perimeter of the upper surface. The cavity region can be defined by a sidewall that extends outward from the plane of the upper surface. In some embodiments, the sidewall extends outward from the plane of the upper surface and simultaneously extends inward toward the center of the upper surface to facilitate retention of the plaster finish. In some embodiments, the aggregate retaining device and/or drain assembly is formed of a clear material so that it is camouflaged by the plaster. The drain assembly can be circular in shape like most conventional drain assemblies; however, the drain assembly can take on a variety of other shapes.

In some embodiments, a drain assembly for an artificial body of water includes one or more of the following: a drain housing configured to pass fluid flow therethrough; a flow controller configured to be positioned at least partially within the drain housing, the flow controller configured to deflect fluid flow around the flow controller and into the drain housing; a first plaster attachment device connected to the flow controller, the first plaster attachment device comprising a first plaster opening and a first sidewall, the first plaster opening configured to receive and support plaster mixtures substantially matching plaster mixtures of a wall configured to contain an artificial body of water, the first plaster opening configured to support plaster at a first desired depth, the first sidewall configured to support plaster at a first desired radius; and/or a second plaster attachment device connected to the drain housing, the second plaster attachment device circumscribing the first plaster attachment device, the second plaster attachment device comprising a channel circumscribing the first plaster opening, the channel configured to receive and support plaster mixtures substantially matching plaster mixtures of the wall configured to contain the artificial body of water, the channel configured to support plaster at a second desired depth. A method of using the foregoing assembly is included; the method of use can include using or assembling any one or more of the foregoing features to achieve functions and/or features of the assembly as discussed in this disclosure. A method of manufacturing the foregoing assembly is included; the method of manufacture can include providing, making, connecting, assembling, and/or installing any one or more of the foregoing features of the assembly to achieve functions and/or features of the assembly as discussed in this disclosure.

In some embodiments, the drain assembly can further include one or more of the following: the first plaster attachment device comprises one or more flanges configured to retain plaster within the first plaster opening; the one or more flanges radially extend into the first plaster opening from the first sidewall; the second plaster attachment device comprises one or more flanges configured to retain plaster within the channel; the one or more flanges radially extend into the channel from a second sidewall at least partially forming the channel; the second plaster attachment device comprises a second sidewall and a third sidewall, the second and third sidewalls at least partially forming the channel, the second sidewall configured to support plaster at a second desired radius greater than the first desired radius, and the third sidewall configured to support plaster at a third desired radius greater than the second desired radius; the first plaster attachment device comprises a protrusion in the first plaster opening, the protrusion extending from a bottom surface of the first plaster opening, the protrusion configured to retain plaster within the first plaster opening; the second plaster attachment device is detachable from the drain housing; at least one of the second plaster attachment device or the drain housing comprises an engagement opening and the other of the second plaster attachment device or the drain housing comprises a protrusion configured to engage the engagement opening to secure the second plaster attachment device to the drain housing; the drain housing comprises ribs proximate to a periphery of the drain housing, the ribs of the drain housing configured to elevate at least a portion of the drain housing away from the wall configured to contain the artificial body of water; the second plaster attachment device comprises ribs proximate to a periphery of the second plaster attachment device, the ribs of the second plaster attachment device configured to elevate at least a portion of the second plaster attachment device away from the wall configured to contain the artificial body of water; the ribs of the drain housing align with the ribs of the second plaster attachment device to create a flow path over the wall to increase flow rate through the drain assembly; the drain housing comprises ribs proximate to a periphery of the drain housing, the ribs configured to elevate at least a portion of the drain housing away from the wall configured to contain the artificial body of water whereby creating a flow path over the wall to increase flow rate through the drain assembly; the drain housing comprises cutouts extending radially adjacent the ribs, the cutouts configured to direct flow along the flow path; the second plaster attachment device is integrally formed with the drain housing; a retention support configured to be positioned in the drain housing at least partially between the flow controller and the drain housing, the retention support comprising ribs configured to support the first plaster attachment device relative to the drain housing; and/or the ribs of the retention support comprise projections configured to allow a corresponding surface of the first plaster attachment device to rest against the ribs in a desired radial position. A method of using the foregoing assembly is included; the method of use can include using or assembling any one or more of the foregoing features to achieve functions and/or features of the assembly as discussed in this disclosure. A method of manufacturing the foregoing assembly is included; the method of manufacture can include providing, making, connecting, assembling, and/or installing any one or more of the foregoing features of the assembly to achieve functions and/or features of the assembly as discussed in this disclosure.

In some embodiments, a drain assembly for an artificial body of water includes one or more of the following: a drain housing configured to pass fluid flow therethrough; a flow controller configured to be positioned at least partially within the drain housing, the flow controller configured to deflect fluid flow around the flow controller and into the drain housing; and/or a plaster attachment device connected to the flow controller, the plaster attachment device comprising a plaster opening, a sidewall, and a protrusion in the plaster opening, the plaster opening configured to receive and support plaster mixtures substantially matching plaster mixtures of a wall configured to contain an artificial body of water, the plaster opening configured to support plaster at a desired depth, the sidewall configured to support plaster at a desired radius, the protrusion extending from a bottom surface of the plaster opening and configured to retain plaster within the plaster opening. A method of using the foregoing assembly is included; the method of use can include using or assembling any one or more of the foregoing features to achieve functions and/or features of the assembly as discussed in this disclosure. A method of manufacturing the foregoing assembly is included; the method of manufacture can include providing, making, connecting, assembling, and/or installing any one or more of the foregoing features of the assembly to achieve functions and/or features of the assembly as discussed in this disclosure.

In some embodiments, the drain assembly can further include one or more of the following: the plaster attachment device comprises one or more flanges configured to retain plaster within the plaster opening; the one or more flanges radially extend into the plaster opening from the sidewall; the drain housing comprises ribs, the ribs configured to elevate at least a portion of the drain housing away from the wall configured to contain the artificial body of water whereby creating a flow path over the wall to increase flow rate through the drain assembly; the ribs are positioned on a surface of the drain housing configured to at least partially face the wall configured to contain the artificial body of water; the drain housing comprises cutouts extending radially adjacent the ribs, the cutouts configured to direct flow along the flow path; the cutouts are positioned on a surface of the drain housing configured to at least partially face the wall configured to contain the artificial body of water; the drain housing comprises a ring circumscribing the plaster attachment device; the ring is detachable from the drain housing; at least one of the ring or the drain housing comprises an engagement opening and the other of the ring or the drain housing comprises a protrusion configured to engage the engagement opening to secure the ring to the drain housing; a retention support configured to be positioned in the drain housing at least partially between the flow controller and the drain housing, the retention support comprising ribs configured to support the plaster attachment device relative to the drain housing; and/or the ribs comprise retention projections configured to allow a corresponding surface of the plaster attachment device to rest against the ribs in a desired radial position. A method of using the foregoing assembly is included; the method of use can include using or assembling any one or more of the foregoing features to achieve functions and/or features of the assembly as discussed in this disclosure. A method of manufacturing the foregoing assembly is included; the method of manufacture can include providing, making, connecting, assembling, and/or installing any one or more of the foregoing features of the assembly to achieve functions and/or features of the assembly as discussed in this disclosure.

In some embodiments, a drain assembly for an artificial body of water includes one or more of the following: a flow controller configured to be positioned at least partially within a drain housing configured to pass fluid flow therethrough, the flow controller configured to deflect fluid flow around the flow controller and into the drain housing; and/or a plaster attachment device connected to the flow controller, the plaster attachment device comprising a plaster opening and a sidewall, the plaster opening configured to receive and support plaster mixtures substantially matching plaster mixtures of a wall configured to contain an artificial body of water, the plaster opening configured to support plaster at a first desired depth, and the sidewall configured to support plaster at a first desired radius. A method of using the foregoing assembly is included; the method of use can include using or assembling any one or more of the foregoing features to achieve functions and/or features of the assembly as discussed in this disclosure. A method of manufacturing the foregoing assembly is included; the method of manufacture can include providing, making, connecting, assembling, and/or installing any one or more of the foregoing features of the assembly to achieve functions and/or features of the assembly as discussed in this disclosure.

In some embodiments, the drain assembly can further include one or more of the following: the plaster attachment device comprises one or more flanges configured to retain plaster within the plaster opening; the one or more flanges radially extend into the plaster opening from the sidewall; a retention support configured to be positioned in the drain housing at least partially between the flow controller and the drain housing, the retention support comprising ribs configured to support the plaster attachment device relative to the drain housing; and/or the ribs comprise projections configured to allow a corresponding surface of the plaster attachment device to reset against the ribs in a desired radial position. A method of using the foregoing assembly is included; the method of use can include using or assembling any one or more of the foregoing features to achieve functions and/or features of the assembly as discussed in this disclosure. A method of manufacturing the foregoing assembly is included; the method of manufacture can include providing, making, connecting, assembling, and/or installing any one or more of the foregoing features of the assembly to achieve functions and/or features of the assembly as discussed in this disclosure.

The foregoing is a summary and contains simplifications, generalization, and omissions of detail. Those skilled in the art will appreciate that the summary is illustrative only and is not intended to be in any way limiting. Other aspects, features, and advantages of the devices and/or processes and/or other subject matter described herein will become apparent in the teachings set forth herein. The summary is provided to introduce a selection of concepts in a simplified form that are further described below in the Detailed Description. This summary is not intended to identify key features or essential features of any subject matter described herein.

BRIEF DESCRIPTION OF THE DRAWINGS

The foregoing and other features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

DETAILED DESCRIPTION

Figure 1:
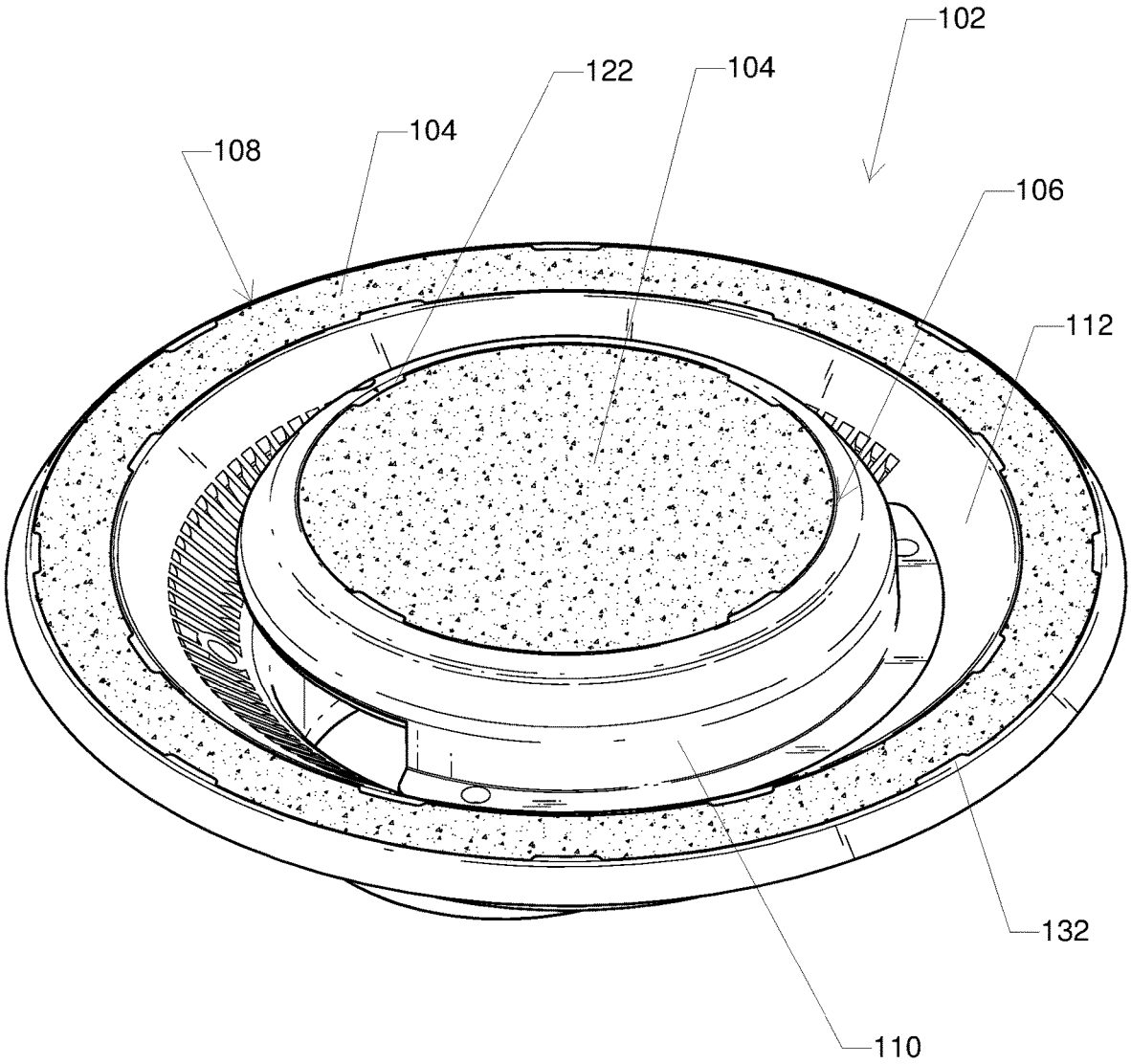
FIG. 1 illustrates a top, side view of an embodiment of a drain assembly with aggregate material.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented herein. It will be readily understood that the aspects of the present disclosure, as generally described herein, and illustrated in the figures, may be arranged, substituted, combined, and designed in a wide variety of different configurations, all of which are explicitly contemplated and made a part of this disclosure.

Figure 2:
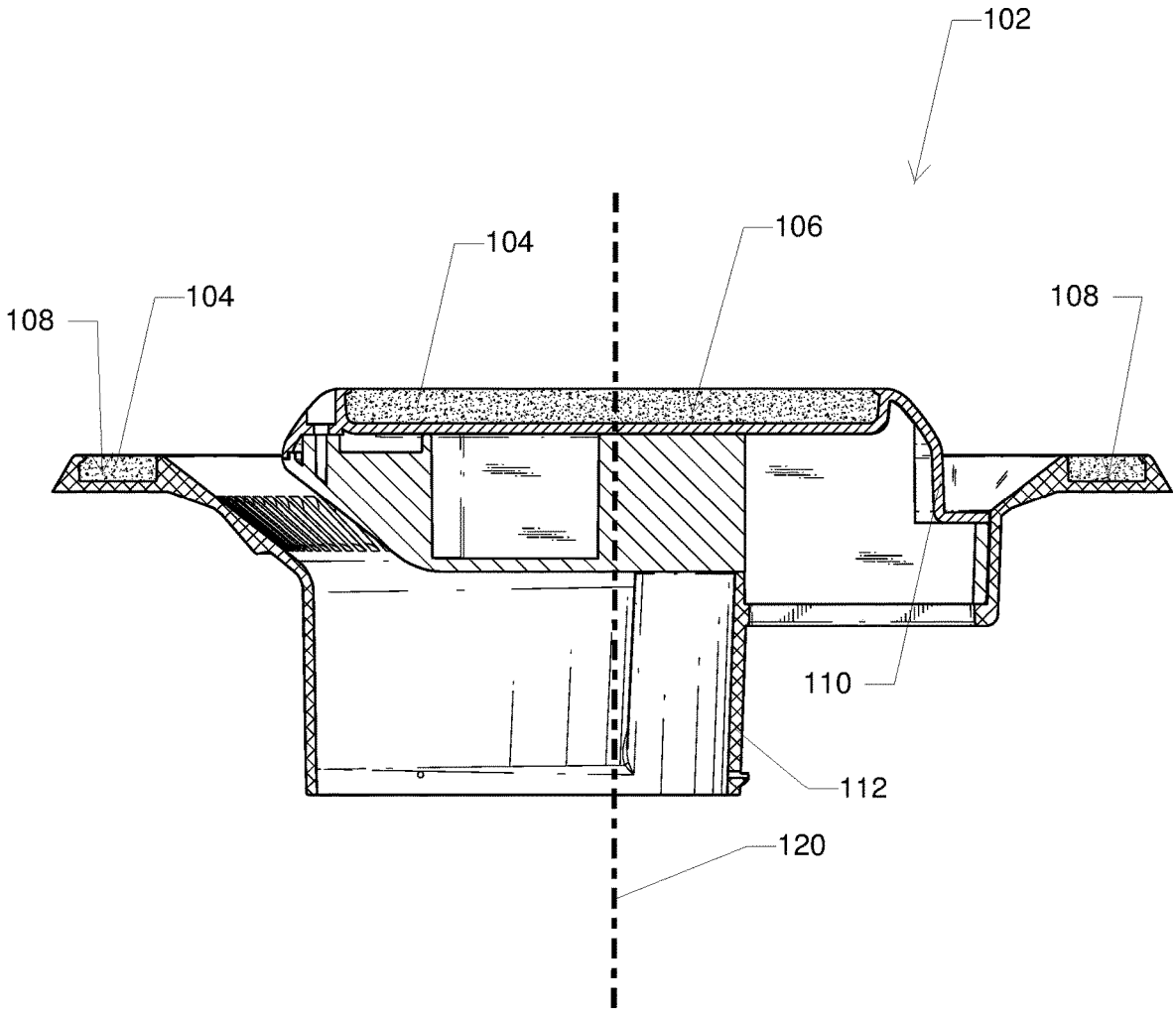
FIG. 2 illustrates a cross-sectional side view of an embodiment of the drain assembly with aggregate material.

FIG. 1 illustrates a top, side view of an embodiment of a drain assembly 102 with aggregate material 104. FIG. 2 illustrates a cross-sectional side view of an embodiment of the drain assembly 102 with aggregate material 104. The drain assembly 102 can have one or more aggregate retaining devices or plaster attachment devices 106, 108 as discussed herein. The drain assembly 102 can have aggregate material 104 as discussed herein positioned on and/or in the drain assembly 102. The plaster attachment devices 106, 108 can contain and/or secure aggregate material 104 in a desired position relative to the drain assembly 102.

A variety of different materials may be used to manufacture the drain assembly 102 and other components as discussed herein. The materials can include high impact plastics that may be fabricated by injection molding. Other materials may be utilized with suitable rigidity and compatibility with the chemicals typically found in, for example, swimming pool or spa environments.

Figure 3:
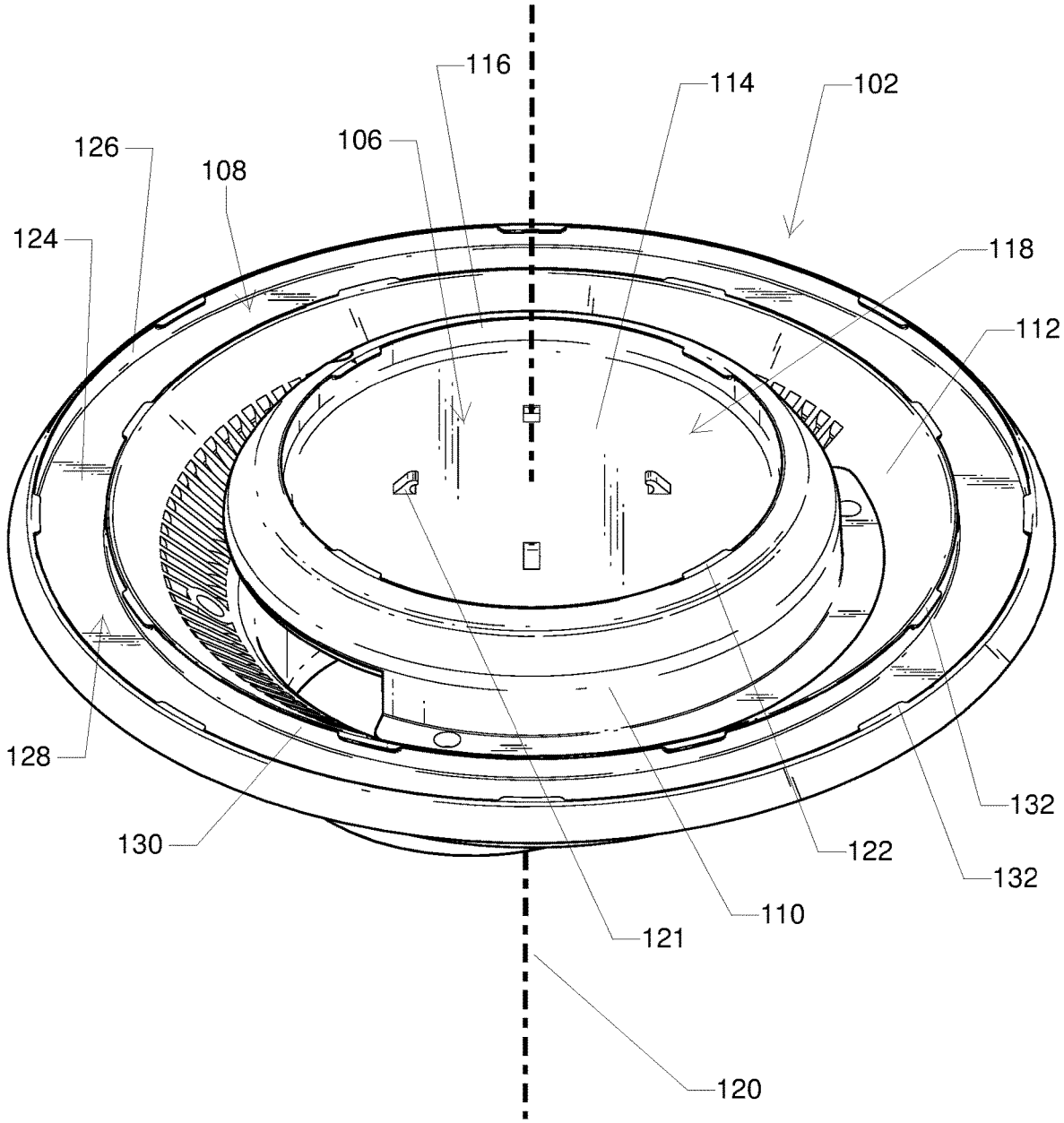
FIG. 3 illustrates a top, side view of an embodiment of a drain assembly without aggregate material for discussion purposes.
Figure 4:
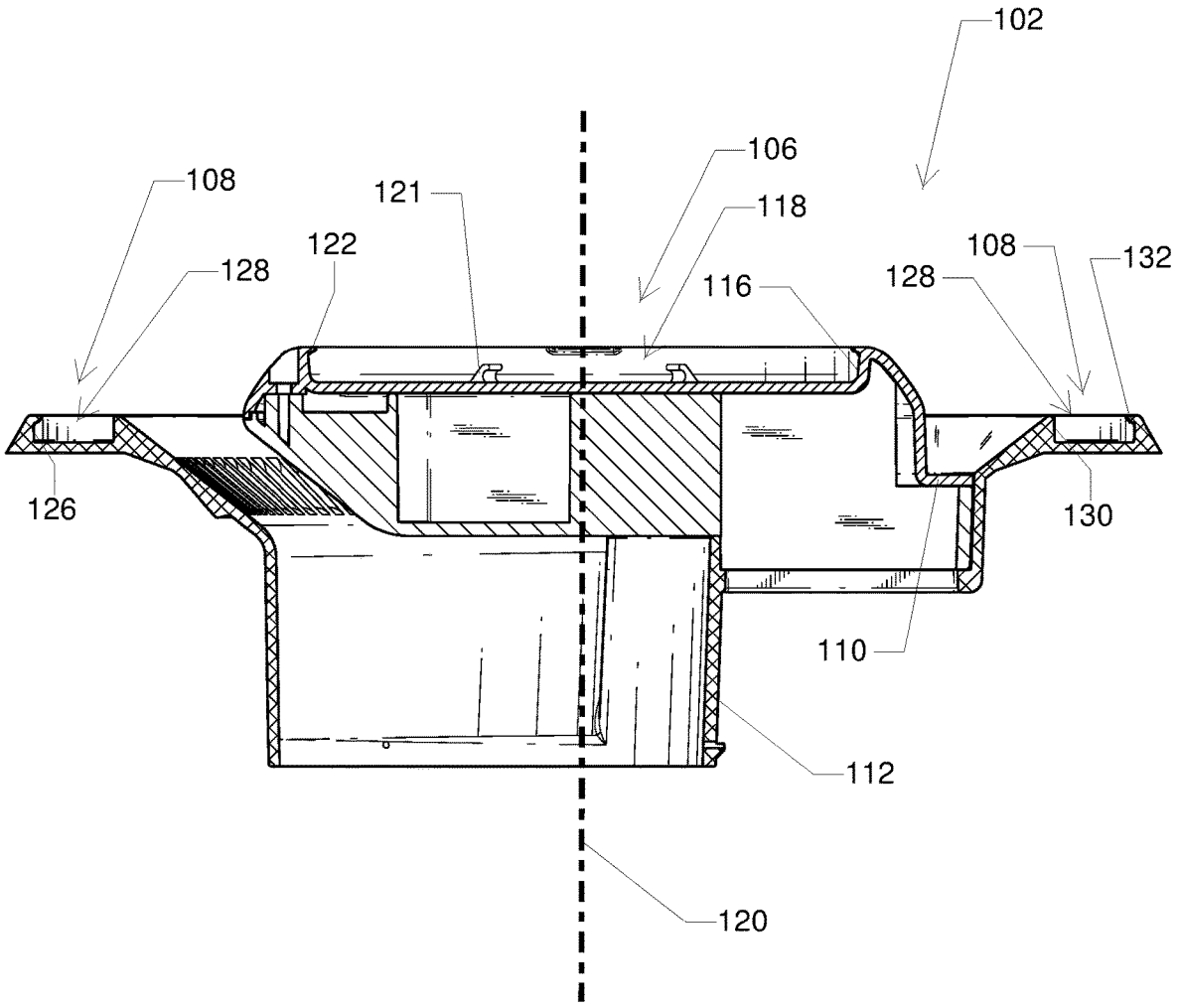
FIG. 4 illustrates a cross-sectional side view of an embodiment of the drain assembly without aggregate material for discussion purposes.

FIG. 3 illustrates a top, side view of an embodiment of a drain assembly 102 without aggregate material 104 for discussion purposes. FIG. 4 illustrates a cross-sectional side view of an embodiment of the drain assembly 102 without aggregate material 104 for discussion purposes. A first plaster attachment device 106 can be connected to and/or integrally formed with a center component or flow controller 110 that is capable of deflecting fluid flow in the drain assembly 102. A second plaster attachment device 108 can be connected to and/or integrally formed with a drain body or housing 112. As illustrated in the figures, housing 112 and the second plaster device 108 may be circular or round. Correspondingly, the flow controller 110 and the first plaster attachment device 106 can be circular or round. In some embodiments, the components of the drain assembly 102 can be circular or have other shapes while achieving the desired functionality as discussed herein. For example, the first plaster attachment device 106, the second plaster attachment device 108, the flow controller 110, and/or the housing, 112 maybe a square, pentagon, hexagon, etc.

In one implementation, the first plaster attachment device 106 has a bottom surface 114 and annular sidewall 116 extending upwardly from the perimeter of the bottom surface 114 to define a plaster opening 118 sized to receive sufficient plaster so that the upper surface of the drain assembly 102 appears to have a finish comprised of plaster or plaster mixed in with loosely compacted mass of fragments or particles such as pebbles. The bottom surface 114 can define a depth of the plaster opening 118 along the central axis 120. The sidewalls 116 can define a radius of the plaster opening 118 about the central axis 120. In one implementation, the depth of the plaster opening 118 is ⅛ inches to 1.5 inches, including ¼ to 1 inches, and 0.5 to 0.75 inches, including the foregoing values and ranges bordering therein. The diameter of the plaster opening 118 is 4 to 12 inches, including 6 to 10 inches, including 7 to 9 inches, including the foregoing values and ranges bordering therein. The sidewalls 116 can be angled relative to a central axis 120 to improve the mechanical bond of the plaster within the plaster attachment device 108.

As illustrated, the plaster attachment device 106 can have flanges or other protrusions, bosses, grooves, indentations, and/or the like 122 to facilitate securing the plaster in the plaster opening 118. The plaster attachment device 106 can have hooks, protrusion, knob, boss and/or the like 121 to facilitate securing the plaster in the plaster opening 118. As illustrated, the hooks 121 can be connected and/or integrally formed with the bottom surface 114. In some embodiments, the hooks 121 can be connected or integrally formed on the annular sidewall 116.

In one implementation, the second plaster attachment device 108 has a bottom surface 124 and annular sidewall 126 (first annular wall) extending upwardly from the perimeter of the bottom surface 124 to define a plaster opening 128 sized to receive sufficient plaster so that the upper surface of the drain assembly 102 appears to have a finish comprised of plaster or plaster mixed in with loosely compacted mass of fragments or particles such as pebbles. As illustrated, the second plaster attachment device 108 can have another or second annular sidewall 130 to define the plaster opening 128 as a channel and/or duct. The plaster opening 128 of the second plaster attachment device 108 can surround and/or circumscribe the plaster opening 118 of the first plaster attachment device 106.

The bottom surface 124 can define a depth of the plaster opening 128 along the central axis 120. The sidewalls 126 can define an outer radius of the plaster opening 128 about the central axis 120. The sidewalls 130 can define an inner radius of the plaster opening 128 about the central axis to form the channel and/or duct as discussed herein. In one implementation, the depth of the plaster opening 128 is ⅛ inches to 1.5 inches, including ¼ to 1 inches, and 0.5 to 0.75 inches, including the foregoing values and ranges bordering therein. The outer diameter of the plaster opening 128 to sidewalls 126 is 8 to 21 inches, including 10 to 18 inches, and 12 to 16 inches, including the foregoing values and ranges bordering therein. The inner diameter of the plaster opening 128 to the sidewalls 130 is 6 to 19 inches, including 8 to 16 inches, and 10 to 14 inches, including the foregoing values and ranges bordering therein. The sidewalls 126 can be angled relative to a central axis 120 to improve the mechanical bond of the plaster within the plaster attachment device 108.

As illustrated, the plaster attachment device 108 can have flanges or other protrusions, bosses, grooves, indentations, and/or the like 132 to facilitate securing the plaster in the plaster opening 128. In some embodiments, the plaster attachment device 108 can have hooks, protrusion, knob, boss and/or the like (similar or same to hooks 121 discussed in reference to plaster attachment device 106) to facilitate securing the plaster in the plaster opening 128. In some embodiments, the hooks can be connected and/or integrally formed with the bottom surface 124. In some embodiments, the hooks can be connected or integrally formed on one or more annular sidewalls 126, 130.

As illustrated in FIGS. 1 and 2, the drain assembly 102 of certain embodiments of the present disclosure includes one or more plaster attachment devices 106, 108 configured to house, retain, contain, support, engage and/or allow attachment of plaster, cement, grout, mortar, sand, binder, pebble, rocks, aggregate material, and/or a surface finish 104 that matches the surface of the walls or floor of pool, spa, water features, or other artificial bodies of water. It is desirable to maximize the exposed surface area of the plaster 104 in the plaster opening 118 such that the drain assembly 102 is substantially camouflaged against the plaster mixture of the surface or wall containing the artificial body of water. Similarly, it may be desirable to maximize the exposed surface area of the plaster 104 in the plaster opening 128 such that the drain assembly 102 is substantially camouflaged against the plaster mixture of the surface or wall containing the artificial body of water As discussed herein, the plaster attachment device 106 has a bottom surface 114 that is coupled to the flow controller 110 and extends substantially radially outward from the central axis 120. The device 106 also has a sidewall 116, which together with the bottom surface 114 define a plaster opening 118 of predetermined size for containing plaster mixtures or the like. The sidewall 116 can be substantially perpendicular to the bottom surface 114. The sidewall 116 can circumscribe or enclose the bottom surface 114. The sidewall 116 can extend circularly about the central axis 120. The sidewall 116 can have a length of about ⅛ inches to 1.5 inches, including ¼ to 1 inches, and 0.5 to 0.75 inches, including the foregoing values and ranges bordering therein, depending on the plaster used. Accordingly, length of the sidewall 116 along the central axis 120 provides a predetermined or desired depth to the plaster opening 118.

As discussed herein, the plaster attachment device 108 has a bottom surface 124 that is coupled to the housing 112 and extends substantially radially outward from the central axis 120. The device 108 also has sidewalls 126, 130, which together with the bottom surface 124 define a plaster opening 128 of predetermined size for containing plaster mixtures or the like. At least one of the sidewalls 126, 130 can be substantially perpendicular to the bottom surface 124. The sidewalls 126, 130 can circumscribe or enclose the bottom surface 124. The sidewalls 126, 130 can extend circularly about the central axis 120. The sidewalls 126, 130 can have a length of about ⅛ inches to 1.5 inches including ¼ to 1 inches, and 0.5 to 0.75 inches, including the foregoing values and ranges bordering therein, depending on the plaster used. Accordingly, length of the sidewalls 126, 130 along the central axis 120 provides a predetermined or desired depth to the plaster opening 128.

To further facilitate attaching the plaster to the waterjet apparatus, the plaster attachment devices 106, 108 can have one or more flanges 122, 132. The flanges 122, 132 can extend radially inward toward or outward away from the central axis 120 so that the flanges 122, 132 press against the plaster. The flanges 122, 132 can help keep the plaster within the plaster openings 118, 128 by substantially inhibiting movement of the plaster out of the plaster openings 118, 128 along the central axis 120. Along with the sidewalls 116, 126, 130 inhibiting movement of the plaster perpendicularly to the central axis 120 and the bottom surfaces 114, 124 inhibiting movement of the plaster downwardly along the central axis 120, the flanges 122, 132 can help securely fix the plaster within the plaster openings 118, 128. As illustrated in FIGS. 1 and 3, the plaster attachment device 106 can have four flanges 122. In some embodiments, the plaster attachment device 106 can have one, two, three, four, five, six, seven or more flanges along the opening 118 to provide a desired secured connection of the plaster 104. As illustrated in FIGS. 1 and 3, the plaster attachment device 108 can have eight flanges 132 along the sidewall 126 and eight flanges along the sidewall 130. In some embodiments, the plaster attachment device 108 can have one, two, three, four, five, six, seven, eight, nine, ten or more flanges along the opening 128 to provide a desired secured connection of the plaster 104.

The plaster attachment device 106 can protrude or extend along the central axis 120 a predetermined dimension or length above the surface containing the artificial body of water (e.g., along the central axis 120). Such a drain assembly 102, and in particular the flow controller 110 and the plaster attachment device 106, may be desirable as a retrofit upgrade to existing cleaning heads that do not correspond or have a surface that does not match plaster of the surface or wall containing the artificial body of water. For example, the housing 112 and other internal components can be retained from existing drain assemblies that may be previously installed in a surface or wall containing the artificial body of water. A component (e.g., fluid controller) of an existing drain assembly can be removed (via a maintenance tool) and replaced by the flow controller 110 with the plaster attachment device 106 as discussed herein having plaster to provide a drain assembly 102 that substantially matches or is camouflaged relative to the surface containing the artificial body of water.

Figure 5:
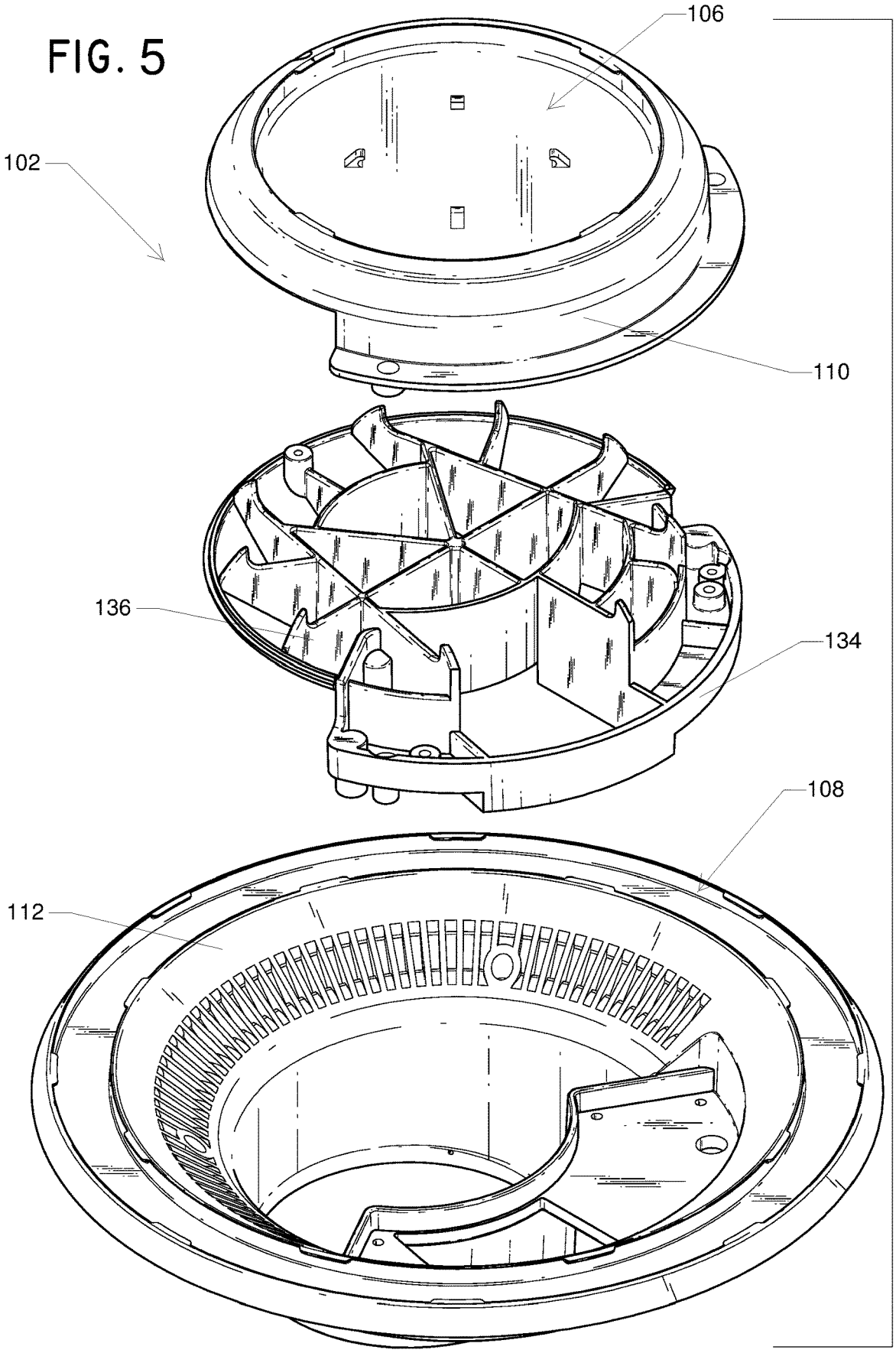
FIG. 5 illustrates an exploded, side, top, isometric view of an embodiment of the drain assembly.

FIG. 5 illustrates an exploded, side, top, isometric view of an embodiment of the drain assembly 102. The drain assembly 102 can have a retention support 134. The retention support 134 can be sized and shaped to connect, mate, or engage the housing 112 using any suitable connection mechanism such as fasteners. The retention support 134 can be sized and shaped to connect, mate, or engage the flow controller 110 and/or the plaster attachment device 106.

Figure 6:
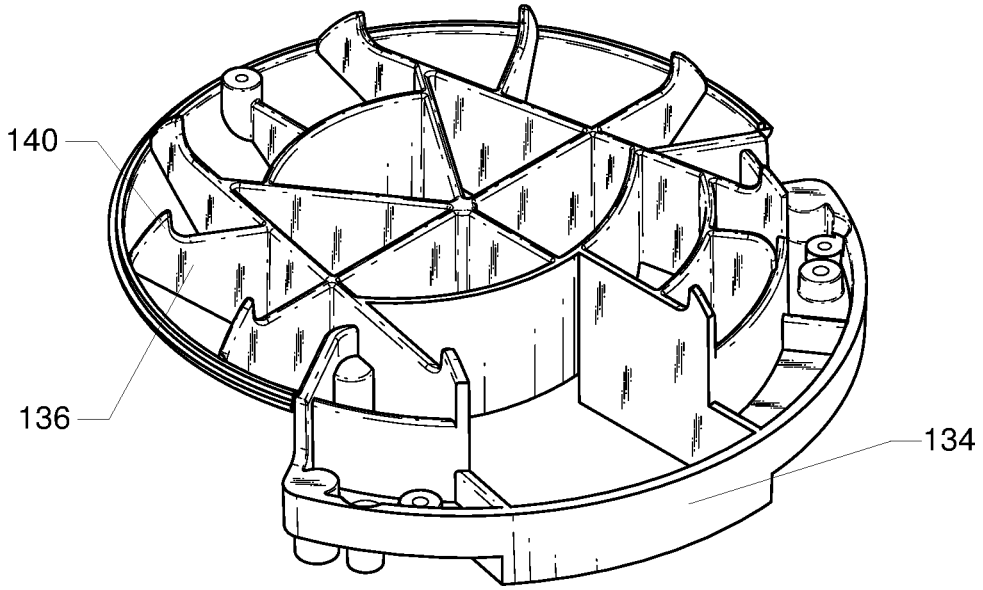
FIG. 6 illustrates a side, top view of an embodiment of the retention support.
Figure 7:
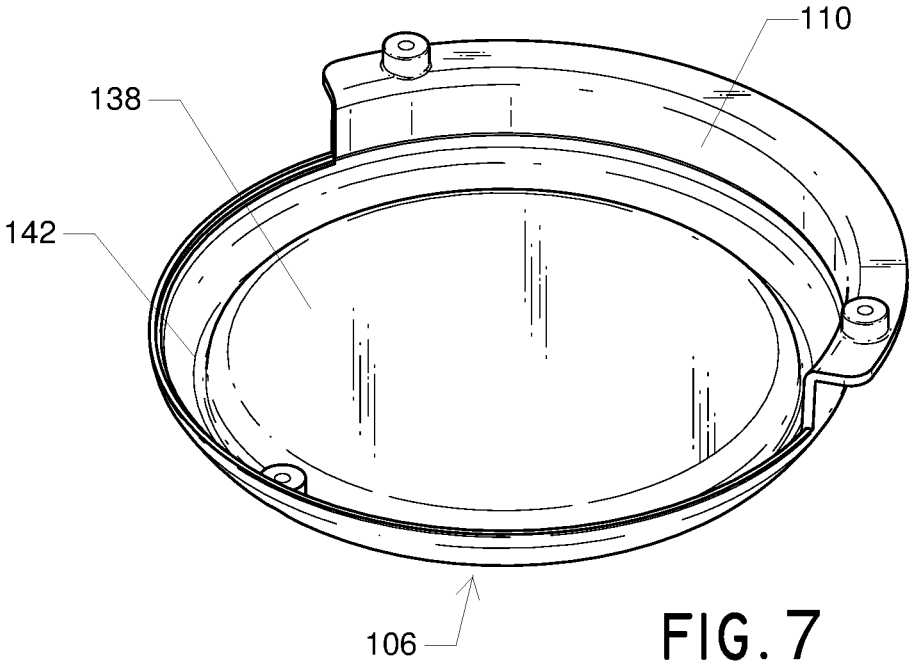
FIG. 7 illustrates a side, bottom view of an embodiment of the flow controller.

FIG. 6 illustrates a side, top view of an embodiment of the retention support 134. FIG. 7 illustrates a side, bottom view of an embodiment of the flow controller 110. The retention support 134 can have one or more ribs, rails, or bars 136 that are sized and shaped to support the flow controller 110 and/or the plaster attachment device 106 in a desired or predetermined position.

As illustrated in FIG. 7, the flow controller 110 can have a convex surface 138 that can be considered to be an extension or a portion of the aggregate retention device 106 or part of the flow controller 110 that accommodates the aggregate retention device 106. The convex surface 138 can be sized and shaped to accommodate the plaster retention device 106. The convex surface 138 can protrude and extend toward the retention support 134 along the central axis 120 when the drain assembly 102 is assembled.

As illustrated in FIG. 6, the ribs 136 can be shaped to correspond to the convex surface 138. The ribs 136 and/or convex surface 138 can be sized and shaped for the ribs 136 to accommodate the convex surface 138 such that the convex surface 138 nests, rests, or is otherwise positioned against the ribs 136 in a desired or predetermined position when the drain assembly 102 is assembled. For example, the ribs 136 can have upward projections 140 that extend into a channel 142 formed by the connection between the flow controller 110 and the convex surface 138.

Figure 8:
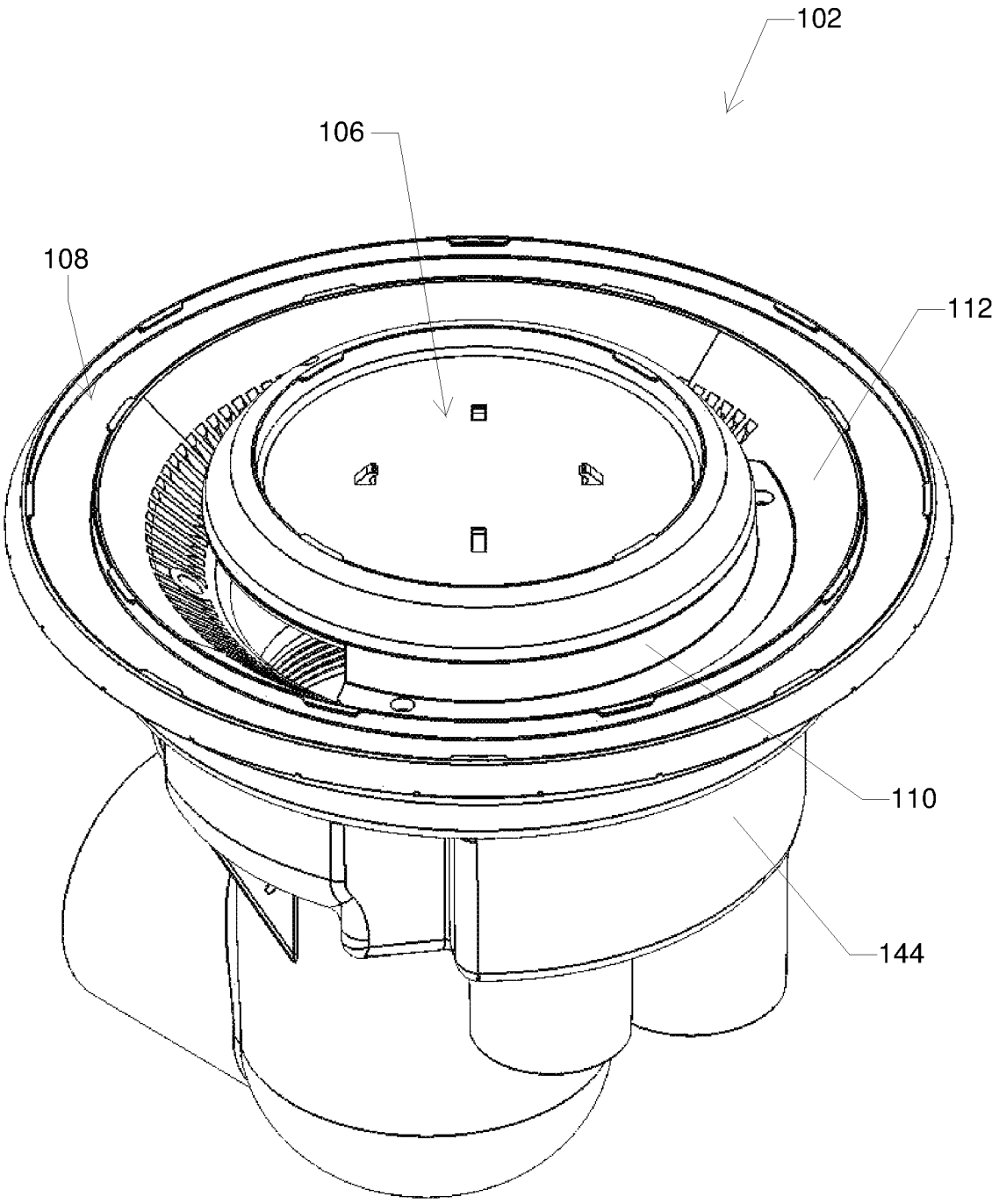
FIG. 8 illustrates a top isometric view of an embodiment of the drain assembly with a sump liner.

FIG. 8 illustrates a top isometric view of an embodiment of the drain assembly 102 with a sump liner 144. As illustrated in FIG. 8, the plaster attachment devices 106, 108 can be operatively connected or engaged with the sump liner 144 via the flow controller 110 and/or housing 112 as discussed herein via any suitable engagement mechanisms such as fasteners and/or protrusions and indentations. The flow controller 110 and/or retention support 134 can be engaged with the housing 112 via any suitable engagement mechanisms such as fasteners and/or protrusions and indentations. The housing 112 can be engaged with sump liner 144 via any suitable engagement mechanisms such as fasteners and/or protrusions and indentations.

The sump liner 144 can engage, mate, and/or connect with the wall of the pool and/or spa. For example, the wall of the pool and/or spa may be a cementitious or otherwise curable material, such as gunnite, that is poured around the sump liner 144. Upon the cementitious material curing, the sump liner 144 can be securely fixed within the wall of the pool and/or spa. Accordingly, the other components of the drain assembly 102 can be securely engaged and/or physically fixed when engaged to the wall of the pool and/or spa via the sump liner 144.

Figure 9:
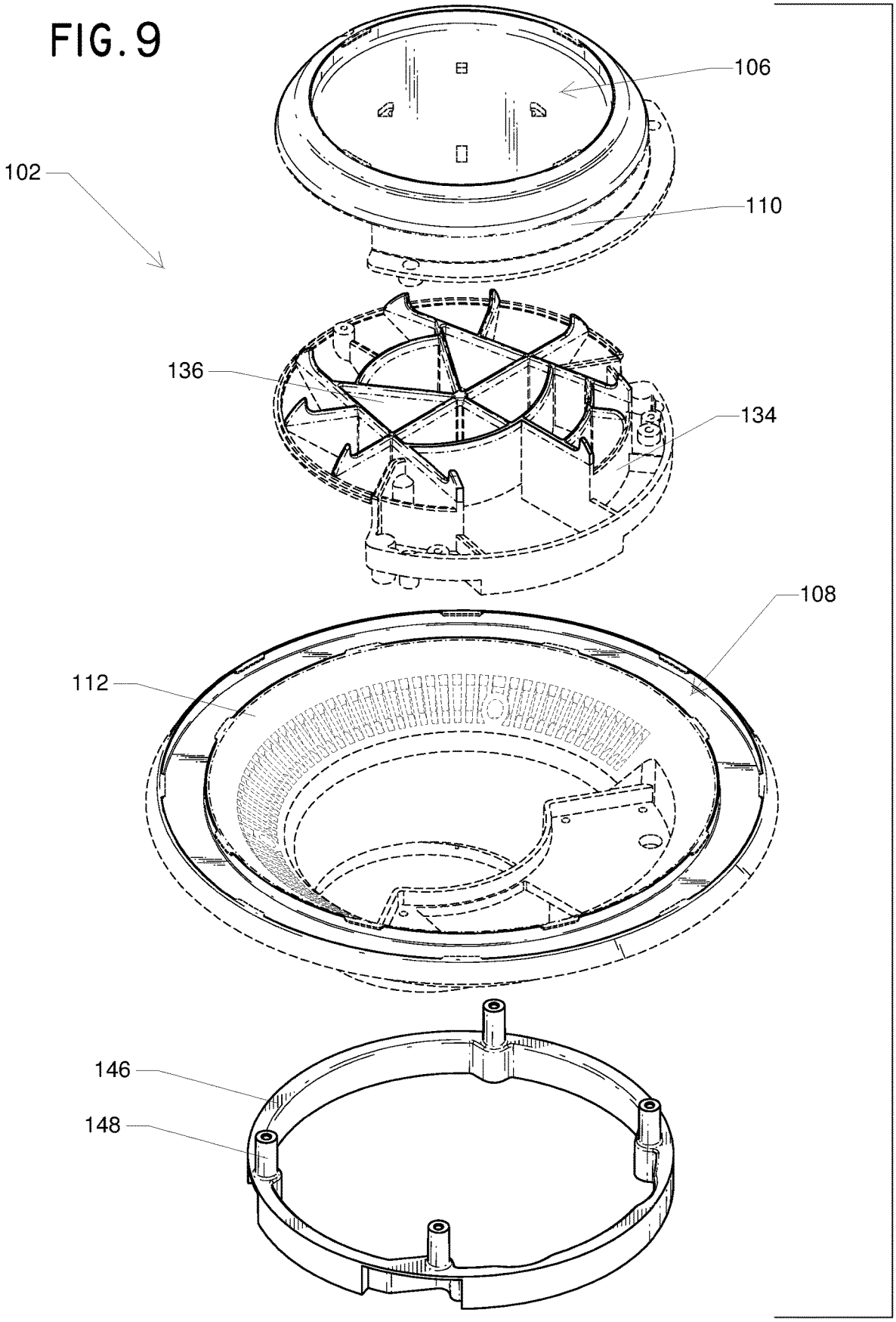
FIG. 9 illustrates an exploded, side, top view of an embodiment of a drain assembly with a sump ring.
Figure 10:
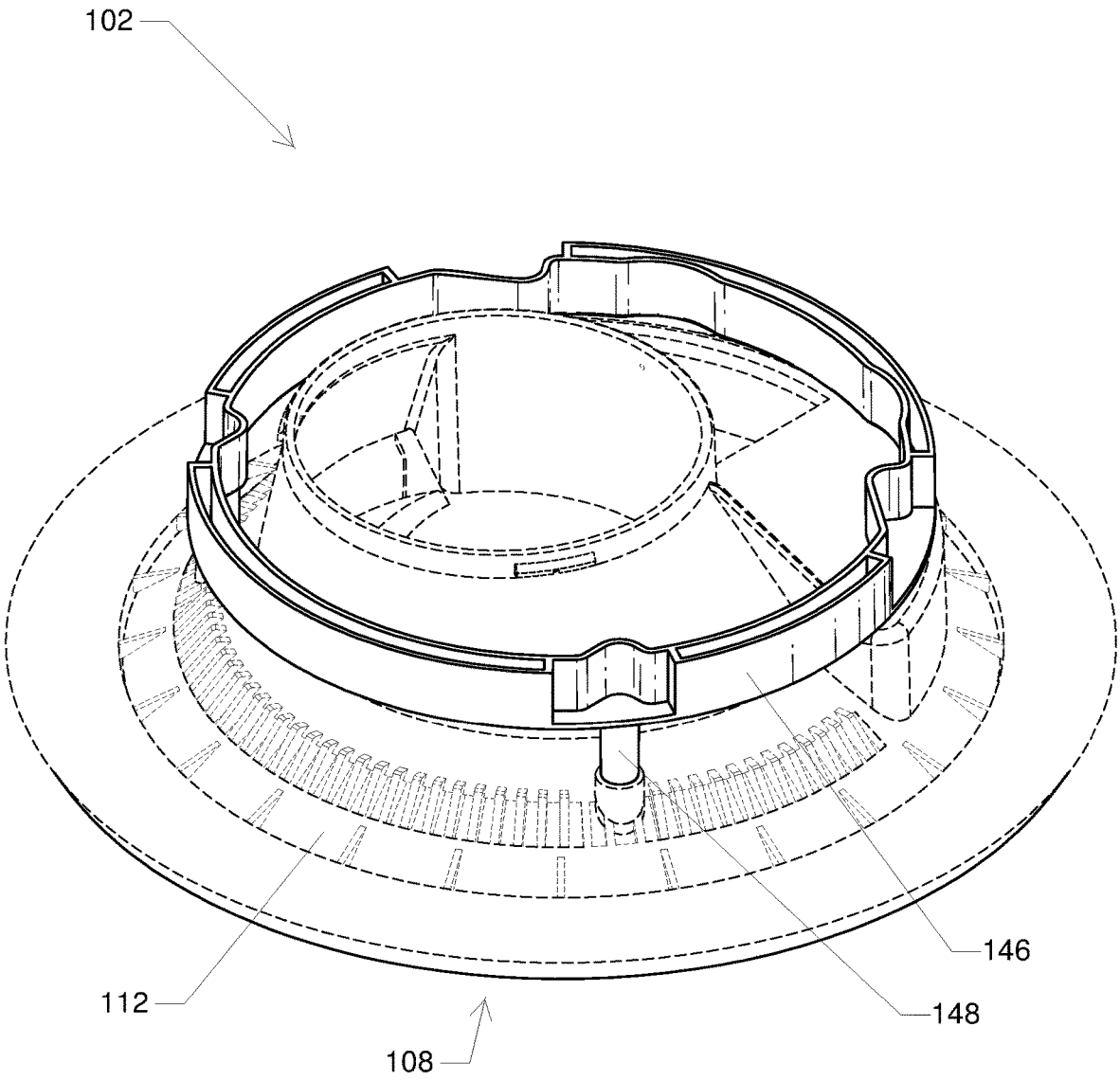
FIG. 10 illustrates a bottom, side view of an embodiment of the sump ring engaged with the housing.

FIG. 9 illustrates an exploded, side, top view of an embodiment of a drain assembly with a sump ring 146. FIG. 10 illustrates a bottom, side view of an embodiment of the sump ring 146 engaged with the housing 112. The sump ring 146 can accommodate and mate, connect, and/or engage with the housing 112 using any suitable mechanism such as fasteners. The sump ring 146 can help orient, position, and engage the drain assembly 102, and in particular, the housing 112 relative to the sump liner 144 to accommodate for example, the aggregate retention devices 106, 108.

The sump ring 146 can have columns 148 that extend from a body of the sump ring 145. The columns 148 can engage, mate, and/or connect with the housing 112 using any suitable attachment mechanism such as fasteners. The columns 148 can have openings to engage with fasteners, for example screws, that are engaged with the housing 112.

Figure 11:
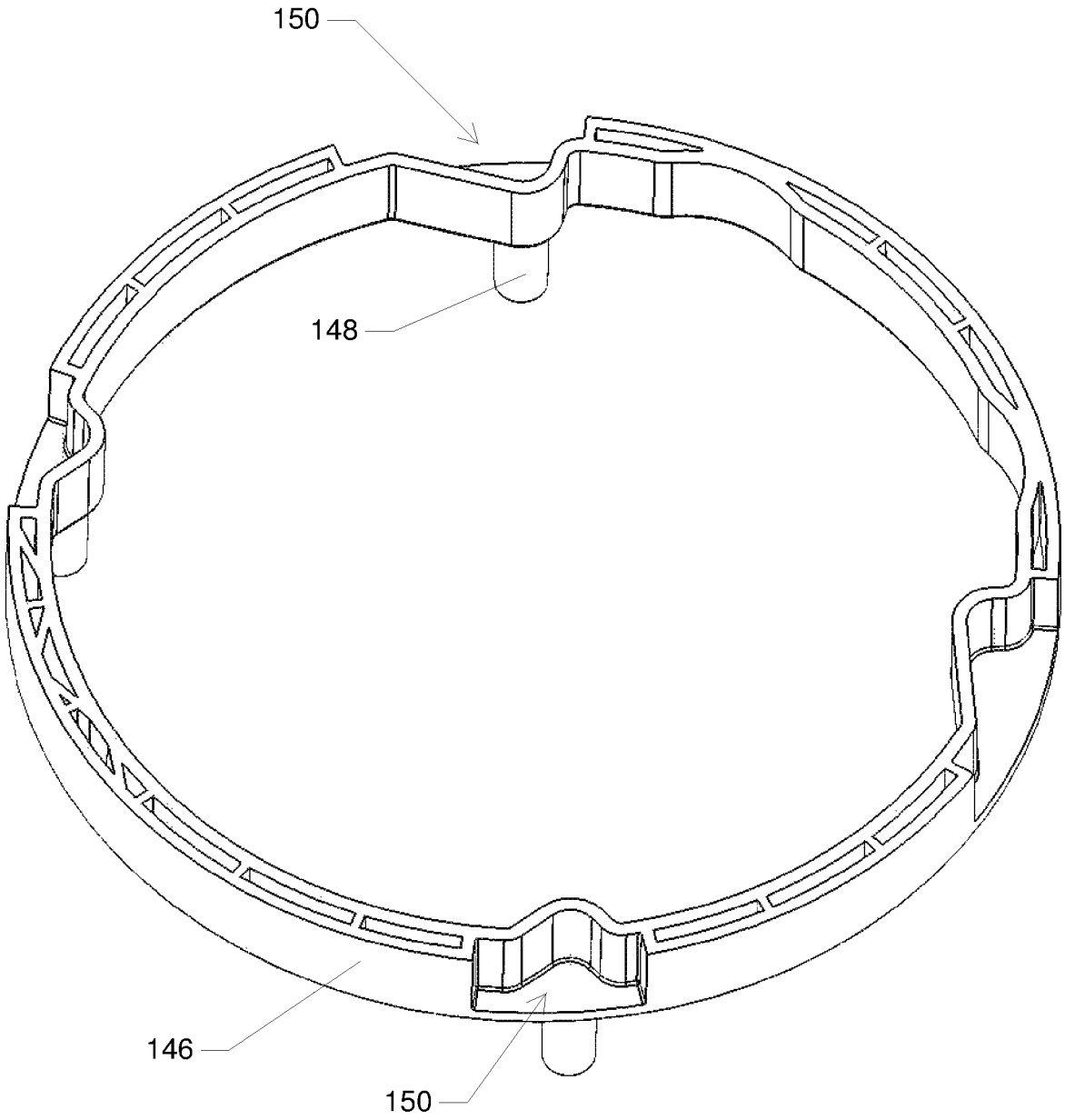
FIG. 11 illustrates a top isometric view of an embodiment of a sump ring.

FIG. 11 illustrates a top isometric view of an embodiment of a sump ring 146. As shown, the sump ring 146 can have supporting ribs, crossover, or other structures between the walls of the sump ring 146 to provide rigidity, strength, and robustness to the sump ring 146. The sump ring 146 can be used as an adapter for sump liners 144 without the use of fasteners such as screws. The sump ring 146 can have cutouts, openings, or holes 150 sized and positioned to accommodate support features of the sump liner 144 that may be present in the interior of the sump liner 144.

Figure 12:
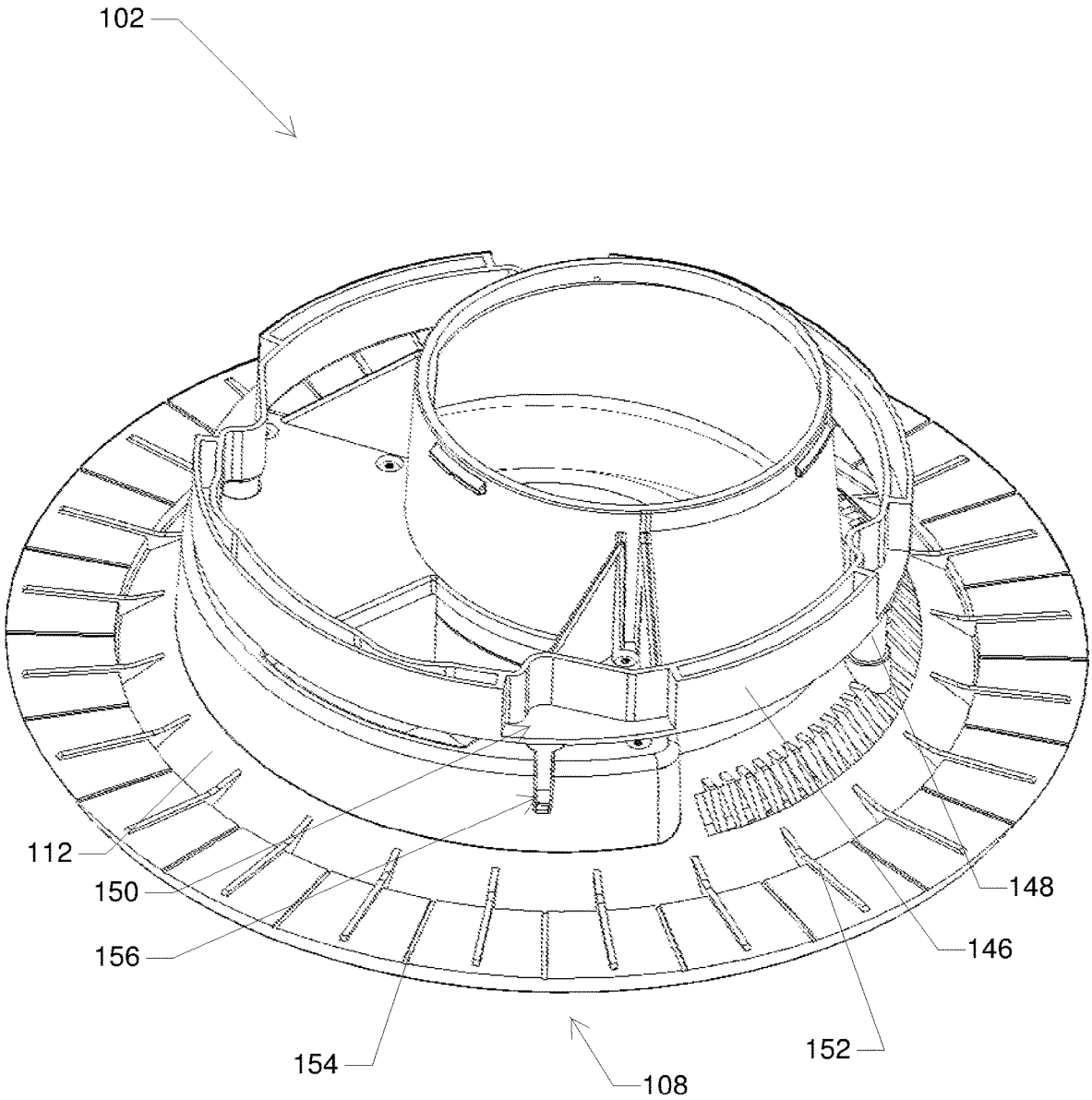
FIG. 12 illustrates a bottom isometric view of an embodiment of a housing.
Figure 13:
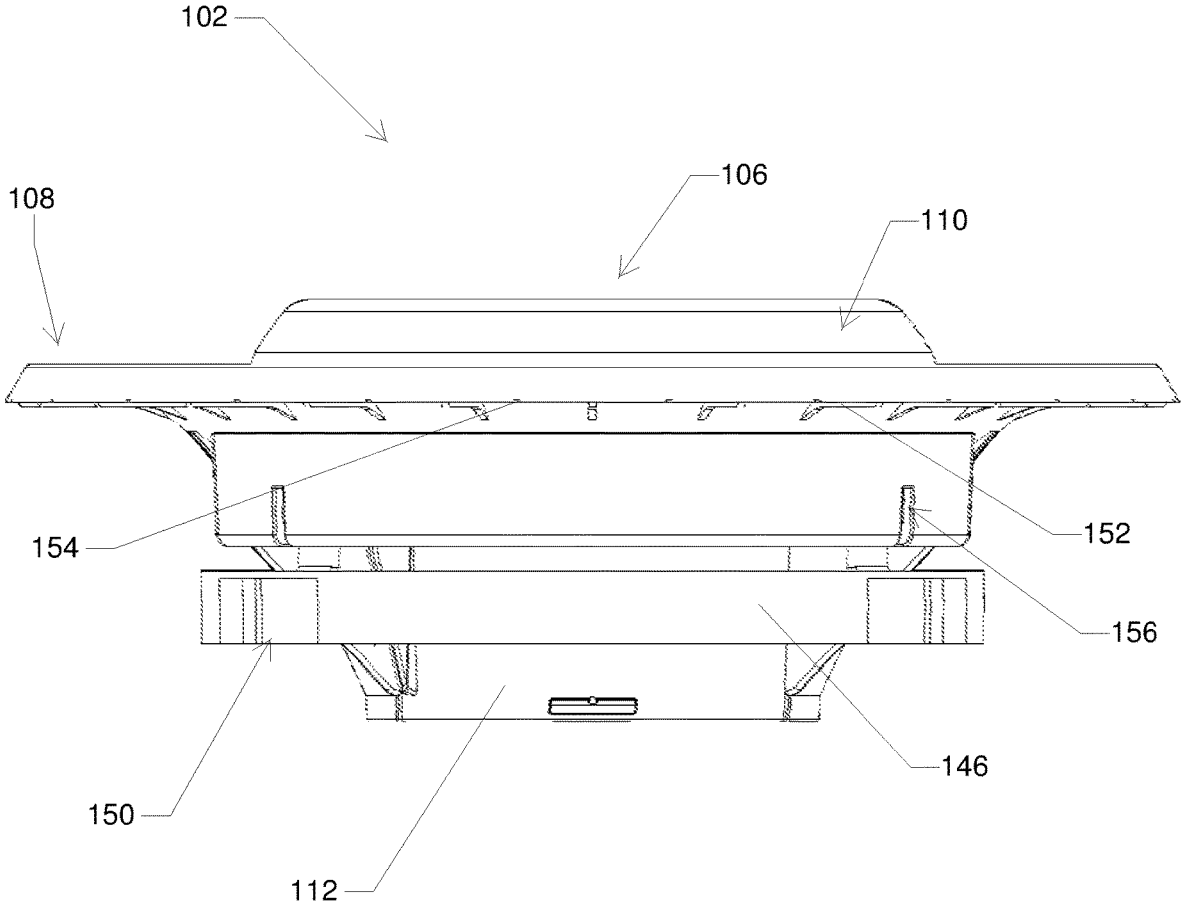
FIG. 13 illustrates a side view of an embodiment of a housing.

FIG. 12 illustrates a bottom isometric view of an embodiment of a housing 112. FIG. 13 illustrates a side view of an embodiment of a housing 112. As shown, the housing 112 can have ribs, protrusion, or other raised structures 152. The ribs 152 can raise the housing 112, and in particular the periphery of the housing 112 relative to the sump liner 144 and/or wall of the pool or spa. The ribs 152 can be directed or oriented to extend toward the center axis 120. By raising or elevating the housing 112 relative to the sump liner 144 and/or wall of the pool or spa, another flow path for the fluid (e.g., liquid water in the pool or spa) can be provided. The other or additional flow path created by the ribs 152 can increase the flow rate and throughput of the drain assembly 102.

As illustrated in FIG. 12, the housing 112 can have channels, cutouts, openings, or indentations 154. The channels 154 can be directed or oriented to extend toward the center axis 120. The channels 154 can facilitate the flow path of the fluid toward the center axis 120 while mitigating turbulent flow.

As illustrated in FIGS. 12 and 13, the housing 112 can have cutouts, openings, or holes 156. The cutouts 156 can be sized and shaped to accommodate certain portions or supports of the sump liner 144. The cutouts 156 can serve a similar function as discussed herein for cutouts 150 of the sump ring 146.

Figure 14:
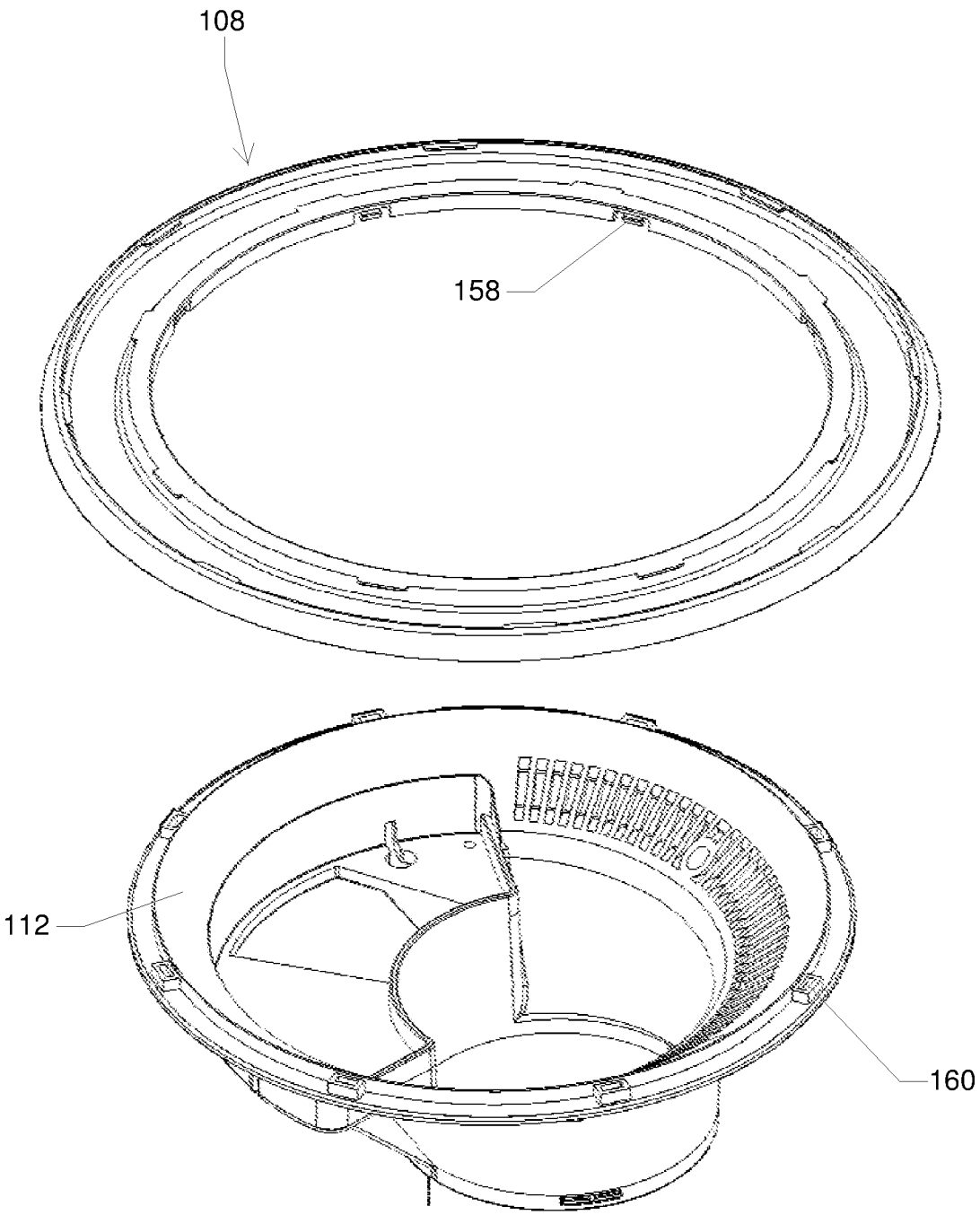
FIG. 14 illustrates a top isometric view of an embodiment of a housing with a modular aggregate retaining device.
Figure 15:
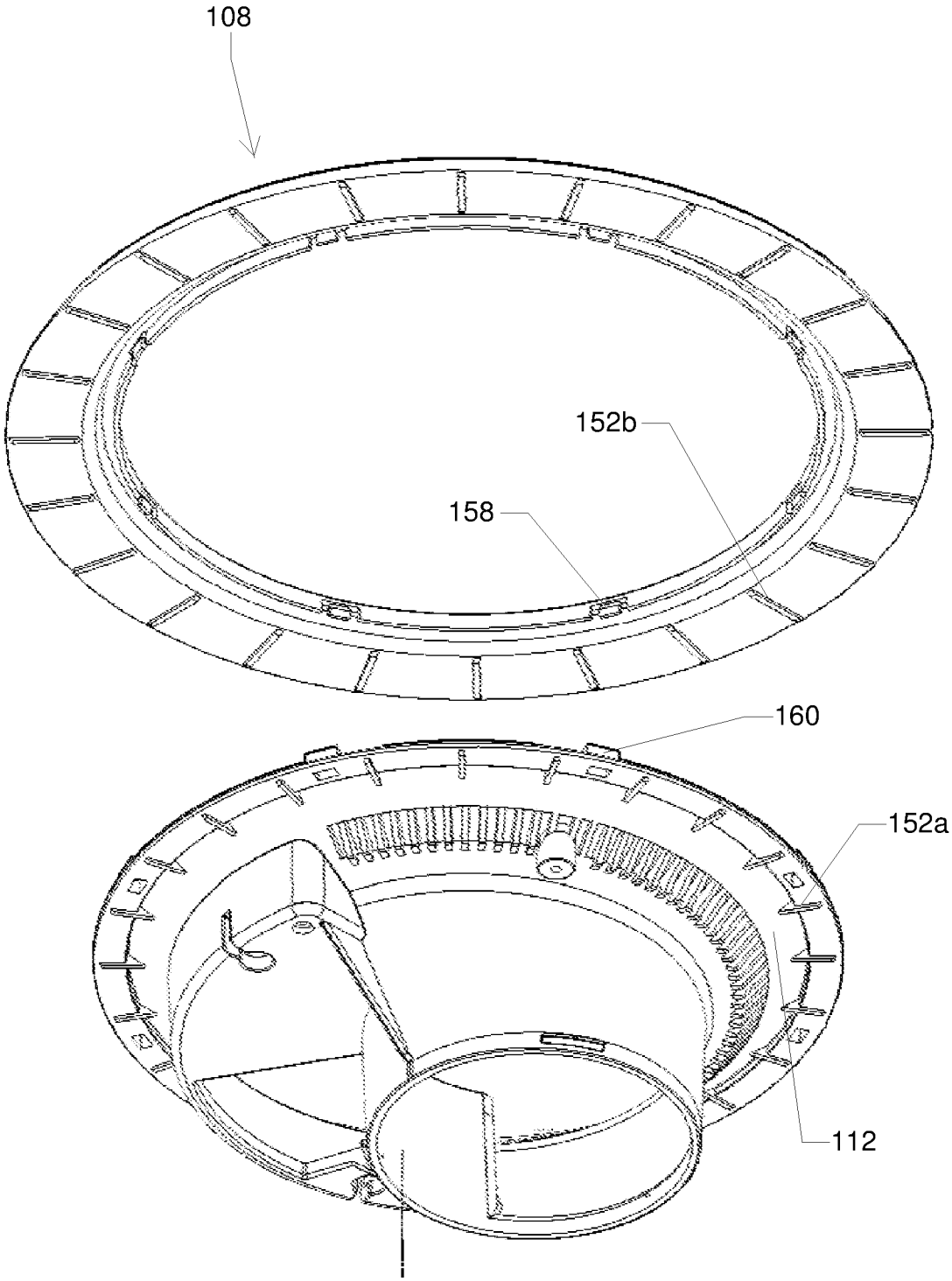
FIG. 15 illustrates a bottom isometric view of an embodiment of a housing with a modular aggregate retaining device.

FIG. 14 illustrates a top isometric view of an embodiment of a housing 112 with a modular aggregate retaining device 108. FIG. 15 illustrates a bottom isometric view of an embodiment of a housing 112 with a modular aggregate retaining device 108. As illustrated, the aggregate retaining device 108 may be selectively detachable from the housing 112. The aggregate retaining device 108 may be of different color materials. The aggregate retaining device 108 may have different plaster/aggregate materials. The aggregate retaining device 108 can be switched as desired before, during, or after installation of the drain assembly 102 into the pool or spa.

The aggregate retaining device 108 and the housing 112 can have complimentary attachment mechanisms. In some embodiments, the aggregate retaining device 108 and the housing 112 can be joined with any suitable mechanism that can hold the aggregate retaining device 108 and the housing 112 together, such as, for example, interference fit mechanisms, snap fit mechanisms, and the like, which can include using male and female mating parts (e.g., tongue-and-groove corresponding parts). As illustrated in FIGS. 14 and 15, the aggregate retaining device 108 can have a male protrusion or projection 158 (e.g., an engagement protrusion or projection). The housing 112 can have a corresponding female opening 160 (e.g., an engagement opening). The male protrusion 158 can have a clasp, and the female opening 160 can have a groove sized and shaped to mate, engage, and/or connect with the clasp of the male protrusion 158 to form a complimentary snap-fit mechanism.

As illustrated in FIG. 15, the housing 112 and the aggregate retaining device 108 can have complimentary/corresponding ribs 152*a*, 152*b* for fluid flow as discussed herein.

Figure 16:
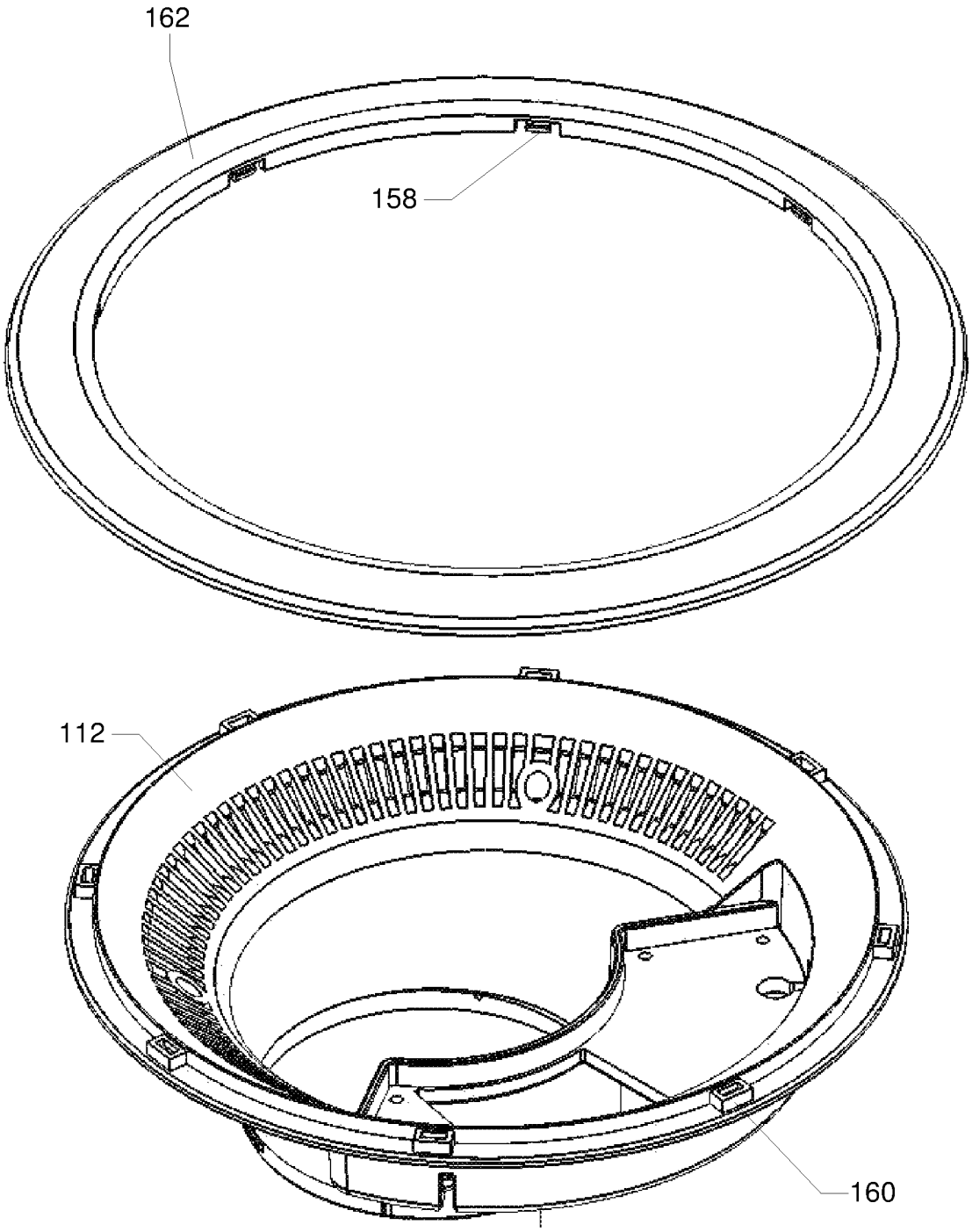
FIG. 16 illustrates a top isometric view of an embodiment of a housing with a modular ring.
Figure 17:
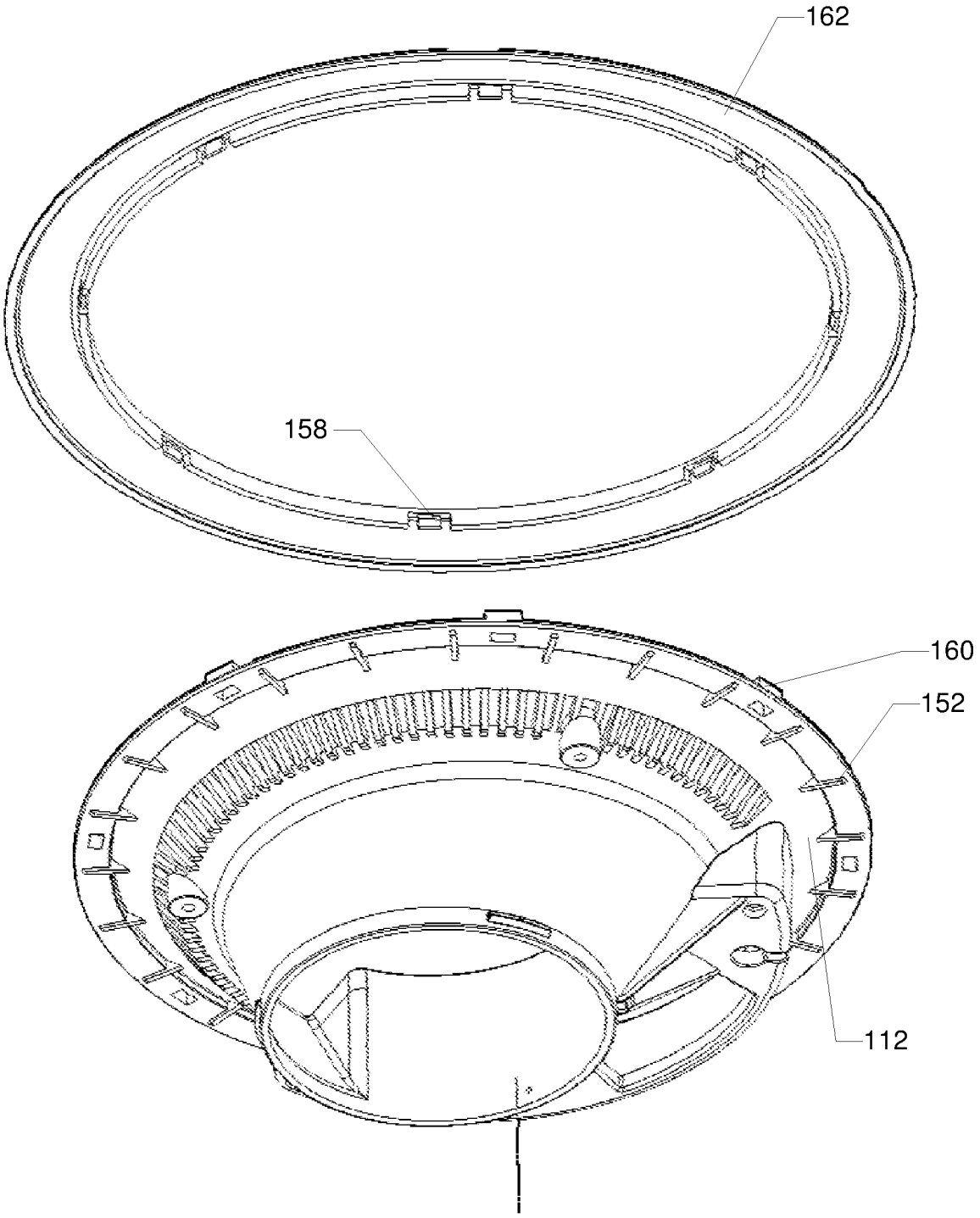
FIG. 17 illustrates a bottom isometric view of an embodiment of a housing with a modular ring.

FIG. 16 illustrates a top isometric view of an embodiment of a housing 112 with a modular ring 162. FIG. 17 illustrates a bottom isometric view of an embodiment of a housing 112 with a modular ring 162. As illustrated, the ring 162 may be selectively detachable from the housing 112. The ring 162 may be of different color materials. The ring 162 can be switched as desired before, during, or after installation of the drain assembly 102 into the pool or spa.

The ring 162 and the housing 112 can have complimentary attachment mechanisms. In some embodiments, the ring 162 and the housing 112 can be joined with any suitable mechanism that can hold the ring 162 and the housing 112 together, such as, for example, interference fit mechanisms, snap fit mechanisms, and the like, which can include using male and female mating parts (e.g., tongue-and-groove corresponding parts). As illustrated in FIGS. 16 and 17, the ring 162 can have a male protrusion 158. The housing 112 can have a corresponding female opening 160. The male protrusion 158 can have a clasp, and the female opening 160 can have a groove sized and shaped to mate, engage, and/or connect with the clasp of the male protrusion 158 to form a complimentary snap-fit mechanism.

As illustrated in FIG. 17, the housing 112 can have ribs 152 for fluid flow as discussed herein.

Figure 18:
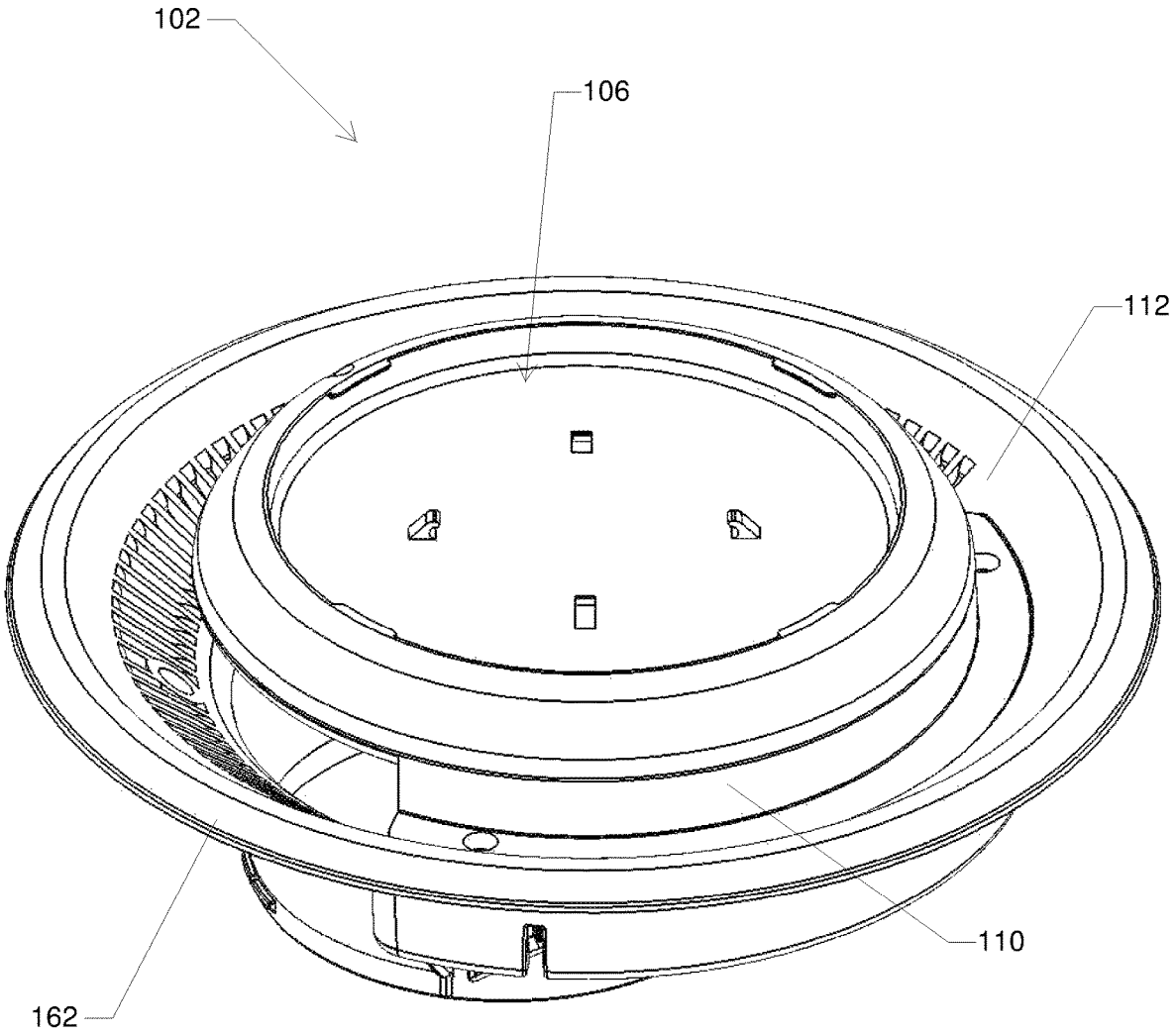
FIG. 18 illustrates a top isometric view of an embodiment of the drain assembly.

FIG. 18 illustrates a top isometric view of an embodiment of the drain assembly 102. The housing 112 can have a ring 162 that is integrally formed with the housing (e.g., a monolithic piece of material forming the housing of the ring 162). The ring 162 can be integrally formed with the housing 112 to minimize the size and dimensions of the ring 162 such that the aggregate retaining device 106 is a prominent component of the drain assembly 102 to better camouflage the drain assembly 102 relative to the pool/spa floor as discussed herein.

Figure 19:
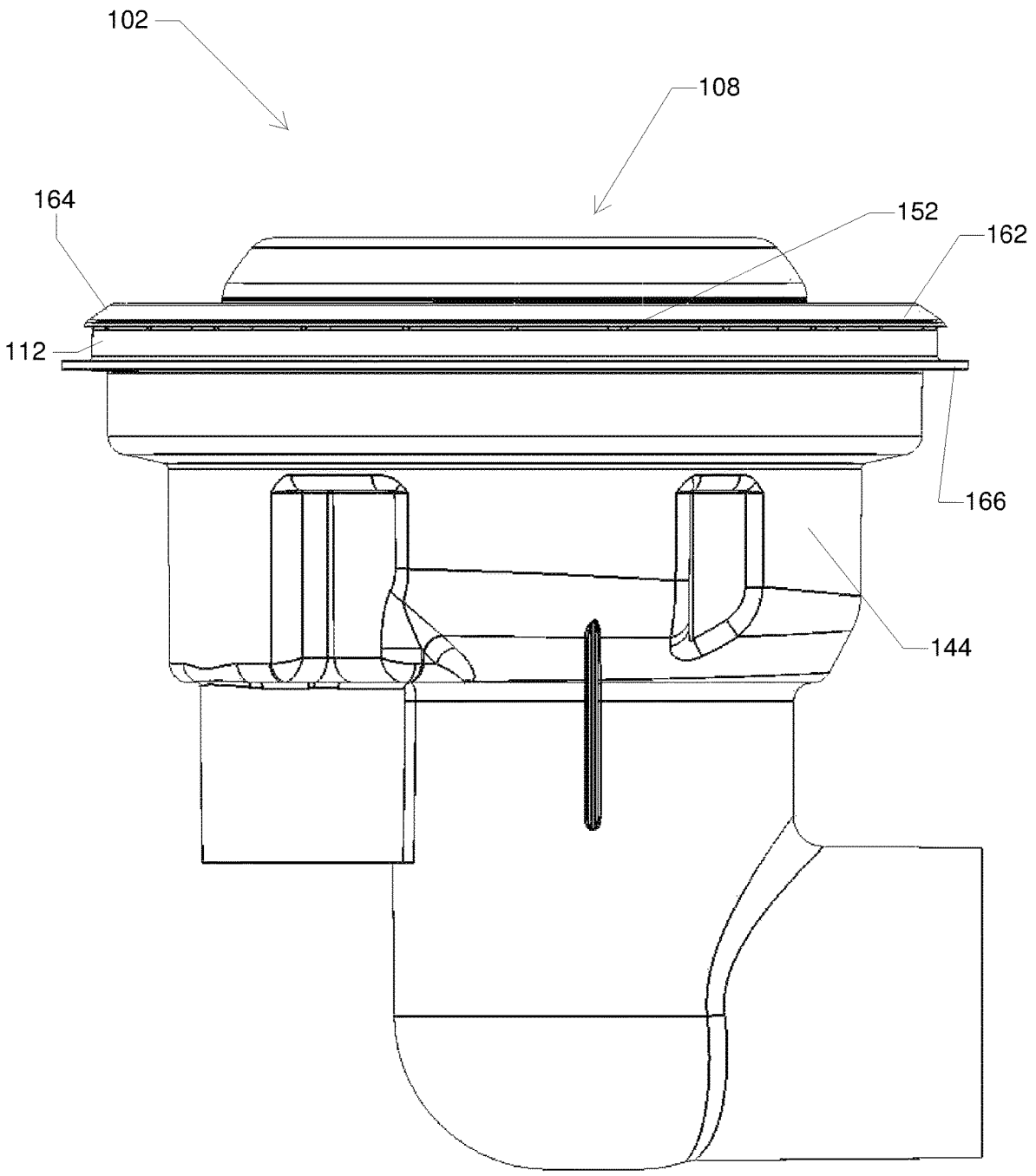
FIG. 19 illustrates a side view of an embodiment of the drain assembly with a sump liner.

FIG. 19 illustrates a side view of an embodiment of the drain assembly 102 with a sump liner 144. As illustrated in FIG. 19, the ring 162 can have a perimeter or periphery that substantially coincides with a perimeter or periphery of the sump liner 144 to minimize the size and dimension of the ring 162 while maintaining the desired functionality of the drain assembly 102. For example, as illustrated in FIG. 19, the housing 112 and/or ring 162 can have ribs 152 for fluid flow as discussed herein. As illustrated, the periphery of the ring 162 can protrude or extend along the radius slightly beyond the periphery of the sump liner 144.

As illustrated in FIG. 19, the ring 162 can have an outer surface or wall 164 that is angled upward to extend generally toward an upper portion or upper surface of the aggregate retaining device 106. The outer surface 164 can extend upward and/or taper upward to provide a more contoured shape to the drain assembly as well as minimize the amount the aggregate retaining device 106 extends beyond the pool/spa floor. The outer wall 164 can be angled for aesthetic as well as safety reasons (e.g., minimize a swimmer stubbing a toe).

In some embodiments, the sump liner 144 can have a water retainer 166 positioned about its perimeter. The water retainer 166 can be a gutter or flange like structure that stops fluid flow at a certain point along the central axis 120 such that water from the pool and/or spa does not proceed into the wall of the pool and/or spa beyond the drain assembly 102.

Figure 20:
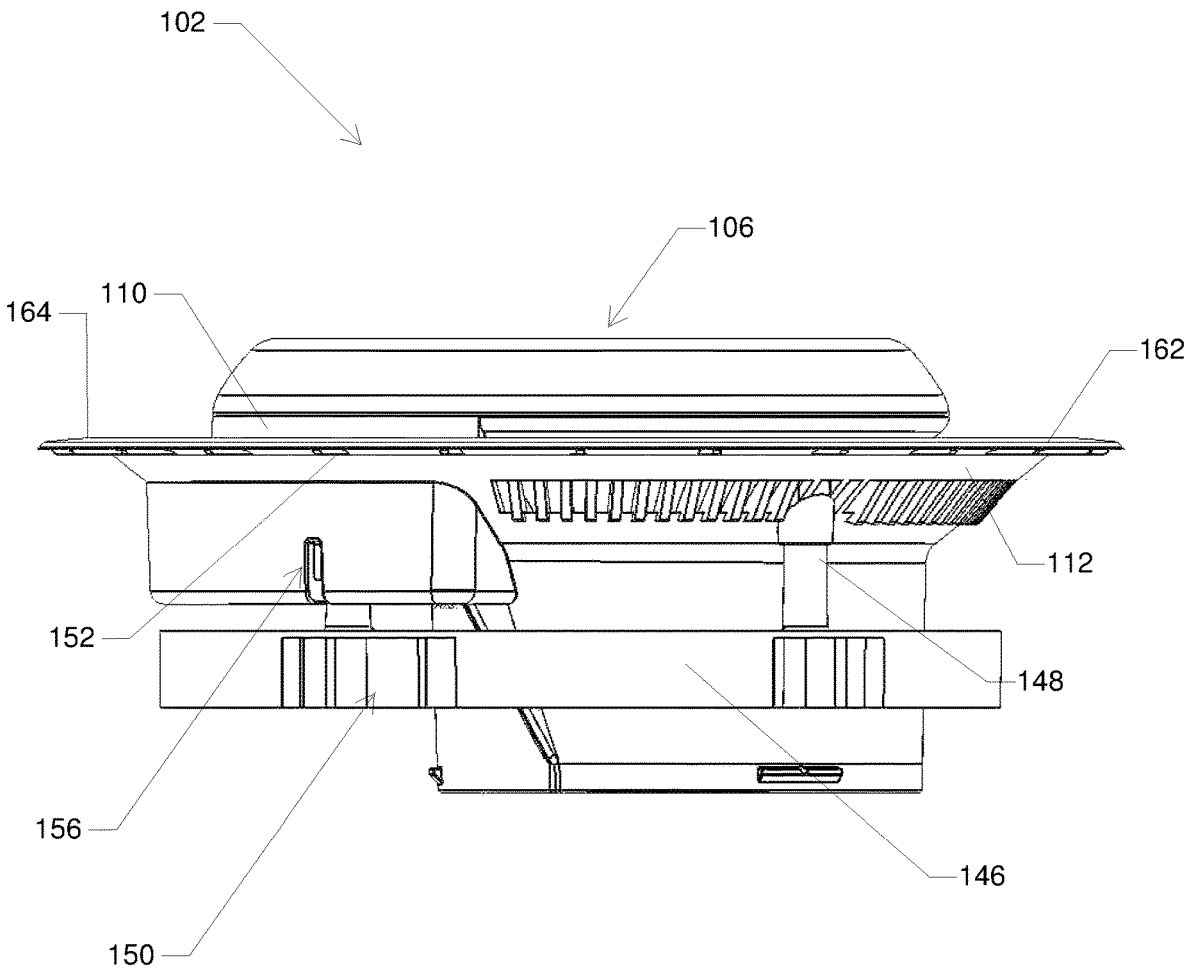
FIG. 20 illustrates a side view of an embodiment of the drain assembly.

FIG. 20 illustrates a side view of an embodiment of the drain assembly. As illustrated in FIG. 20, the ring 162 can have an outer surface or wall 164 that rises or is angled less than the wall 164 illustrated in FIG. 19 relative to a plan perpendicular to the central axis 120. The outer surface 164 can be substantially flush and/or generally coplanar with the pool/spa floor to minimize the drain assembly 102 protruding beyond the pool/spa floor. For example, the angle of the outer surface 164 relative to a plane perpendicular to the central axis 120 can be 2 to 60 degrees, including 2 to 45 degrees, including 5 to 30 degrees, including 5 to 20 degrees, including the foregoing values and ranges bordering therein.

In some embodiments, the drain assembly 102 can include caps that mate, engage, and connect with the aggregate retaining devices 106, 108 to cover up the openings 118, 128. The caps can be used when it is not desired to have plaster/aggregate material in the drain assembly 102.

Figure 21:
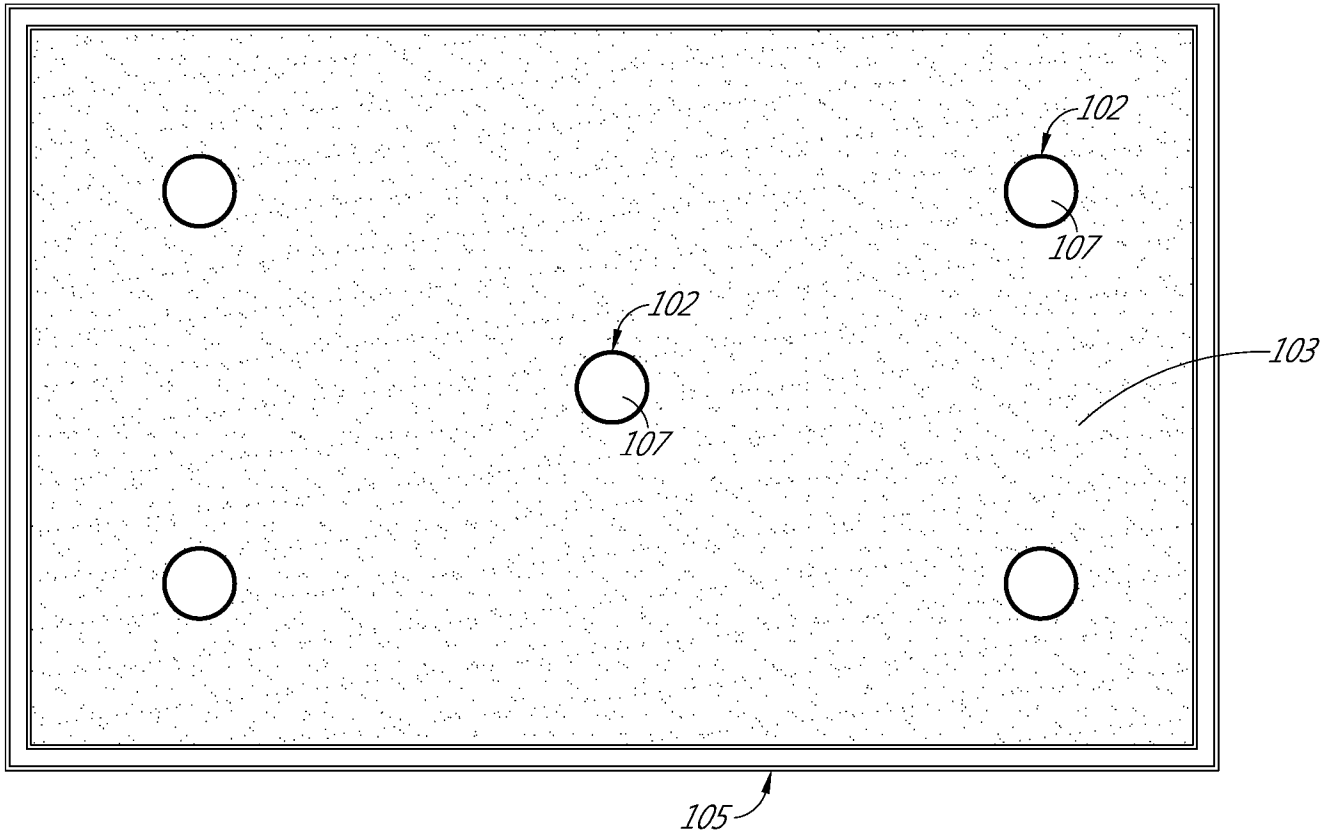
FIG. 21 illustrates one or more drain assemblies positioned in a surface finish that can contain an artificial body water.

FIG. 21 illustrates one or more drain assemblies 102 positioned in a surface finish 103 that can contain an artificial body of water (e.g., a pool or spa 105). As discussed herein, the drain assembly 102 can have surface finish 107 (e.g., plaster/aggregate material 104 as discussed herein) with a pattern made to match the surrounding surface 103 of, for example, the pool. The surface finish 107 can substantially conceal one or more drain assemblies 102 of, for example, a cleaning system of a pool/spa 105 such that the drain assemblies 102 substantially blend into the pebble-type finish or sand-like finish 103 provided in many modern swimming pool/spa 105. For example, plaster resembling sand or pebbles can be used as part of the finish of the interior surface or wall of the pool/spa 105. The finish 103 can be produced in a wide variety of colors and textures.

Various embodiments and examples of assemblies have been disclosed. Although the assemblies have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above.

What is claimed is:

1. A drain assembly for an artificial body of water, the drain assembly comprising:

a drain housing configured to pass fluid flow therethrough, an outflow portion of the drain housing extending along a longitudinal axis and disposed at a radius from the longitudinal axis;

a flow controller configured to be positioned at least partially within the drain housing, the flow controller configured to deflect fluid flow around the flow controller and into the drain housing;

a first plaster attachment device connected to the flow controller, the first plaster attachment device comprising a first plaster opening and a first sidewall, the first plaster opening configured to receive and support plaster mixtures substantially matching plaster mixtures of a wall configured to contain an artificial body of water, the first plaster opening configured to support plaster at a first desired depth, the first sidewall disposed at a first desired radius from a central axis, the first sidewall configured to support plaster at the first desired radius, the central axis spaced apart from the longitudinal axis; and a second plaster attachment device connected to the drain housing, the second plaster attachment device circumscribing the first plaster attachment device, the second plaster attachment device comprising a channel circumscribing the first plaster opening, the channel configured to receive and support plaster mixtures substantially matching plaster mixtures of the wall configured to contain the artificial body of water, the channel configured to support plaster at a second desired depth, the channel spaced radially away from the first plaster opening, the second desired depth extending parallel to the central axis to a surface of the channel, the surface configured to support plaster that is separate from plaster mixtures of the wall, the surface extending perpendicular to the central axis.

2. The drain assembly of claim 1, wherein the first plaster attachment device comprises one or more flanges configured to retain plaster within the first plaster opening.

3. The drain assembly of claim 2, wherein the one or more flanges radially extend into the first plaster opening from the first sidewall.

4. The drain assembly of claim 1, wherein the second plaster attachment device comprises a second sidewall and a third sidewall, the second and third sidewalls at least partially forming the channel, the second sidewall configured to support plaster at a second desired radius greater than the first desired radius, and the third sidewall configured to support plaster at a third desired radius greater than the second desired radius.

5. The drain assembly of claim 1, wherein the second plaster attachment device is detachable from the drain housing.

6. The drain assembly of claim 5, wherein at least one of the second plaster attachment device or the drain housing comprises an engagement opening and the other of the second plaster attachment device or the drain housing comprises a protrusion configured to engage the engagement opening to secure the second plaster attachment device to the drain housing.

7. The drain assembly of claim 1, wherein the second plaster attachment device is integrally formed with the drain housing.

8. A drain assembly for an artificial body of water, the drain assembly comprising:

a drain housing configured to pass fluid flow therethrough, the drain housing comprising an outflow opening through which fluid flow exits the drain housing;

a flow controller configured to be positioned at least partially within the drain housing, the flow controller configured to deflect fluid flow around the flow controller and into the drain housing;

a plaster attachment device connected to the flow controller, the plaster attachment device comprising a plaster opening, a sidewall, and a protrusion in the plaster opening, the plaster opening configured to receive and support plaster mixtures substantially matching plaster mixtures of a wall configured to contain an artificial body of water, the plaster opening configured to support plaster at a desired depth, the sidewall configured to support plaster at a desired radius, the protrusion extending from a bottom surface of the plaster opening and configured to retain plaster within the plaster opening, wherein at least a portion of the outflow opening is disposed radially beyond the plaster opening; and one or more ribs having a longitudinal extent perpendicular to a central axis of the drain housing, the ribs configured to contact the wall and vertically elevate at least a portion of the drain housing away from the wall configured to contain the artificial body of water whereby creating a flow path over the wall to increase flow rate through the drain assembly, wherein the ribs are positioned on a surface of the drain housing configured to at least partially face the wall configured to contain the artificial body of water.

9. The drain assembly of claim 8, wherein the drain housing comprises cutouts extending radially adjacent the ribs, the cutouts configured to direct flow along the flow path.

10. The drain assembly of claim 9, wherein the cutouts are positioned on a surface of the drain housing configured to at least partially face the wall configured to contain the artificial body of water.

11. The drain assembly of claim 8, wherein the drain housing comprises a ring circumscribing the plaster attachment device.

12. The drain assembly of claim 11, wherein the ring is detachable from the drain housing.

13. The drain assembly of claim 12, wherein at least one of the ring or the drain housing comprises an engagement opening and the other of the ring or the drain housing comprises a protrusion configured to engage the engagement opening to secure the ring to the drain housing.

14. The drain assembly of claim 8, further comprising a retention support configured to be positioned in the drain housing at least partially between the flow controller and the drain housing, the retention support comprising ribs configured to support the plaster attachment device relative to the drain housing.

15. The drain assembly of claim 14, wherein the ribs comprise retention projections configured to allow a corresponding surface of the plaster attachment device to rest against the ribs in a desired radial position.

16. A drain assembly for an artificial body of water, the drain assembly comprising: a drain housing configured to pass fluid flow therethrough;

a flow controller configured to be positioned at least partially within the drain housing, the flow controller configured to deflect fluid flow around the flow controller and into the drain housing;

a plaster attachment device connected to the flow controller, the plaster attachment device comprising a plaster opening and a sidewall, the plaster opening configured to receive and support plaster mixtures substantially matching plaster mixtures of a wall configured to contain an artificial body of water, the plaster opening configured to support plaster at a first desired depth, and the sidewall configured to support plaster at a first desired radius; and one or more indentations having a longitudinal extent perpendicular to a central axis of the drain housing, the indentations configured to create a flow path over the wall to increase flow rate through the drain assembly, the indentations positioned on a surface of the drain housing configured to face the wall for containing the artificial body of water, the surface extending perpendicular to the central axis, wherein the flow controller supports the plaster attachment device as a cantilever.

17. The drain assembly of claim 16, wherein the plaster attachment device comprises one or more flanges configured to retain plaster within the plaster opening.

18. The drain assembly of claim 17, wherein the one or more flanges radially extend into the plaster opening from the sidewall.

* * * * *